US010939214B2

(12) United States Patent
Kuntzman et al.

(10) Patent No.: US 10,939,214 B2
(45) Date of Patent: Mar. 2, 2021

(54) ACOUSTIC TRANSDUCERS WITH A LOW PRESSURE ZONE AND DIAPHRAGMS HAVING ENHANCED COMPLIANCE

(71) Applicant: KNOWLES ELECTRONICS, LLC, Itasca, IL (US)

(72) Inventors: Michael Kuntzman, Itasca, IL (US); Michael Pedersen, Itasca, IL (US); Sung Bok Lee, Itasca, IL (US); Bing Yu, Itasca, IL (US); Vahid Naderyan, Itasca, IL (US); Peter Loeppert, Itasca, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/593,263

(22) Filed: Oct. 4, 2019

(65) Prior Publication Data

US 2020/0112799 A1 Apr. 9, 2020

Related U.S. Application Data

(60) Provisional application No. 62/742,153, filed on Oct. 5, 2018.

(51) Int. Cl.

| | |
|---|---|
| ***H04R 19/04*** | (2006.01) |
| ***H04R 7/14*** | (2006.01) |
| ***H04R 7/18*** | (2006.01) |

(52) U.S. Cl.

CPC ..... *H04R 19/04* (2013.01); *H04R 7/14* (2013.01); *H04R 7/18* (2013.01); *H04R 2201/003* (2013.01)

(58) Field of Classification Search

CPC ..... H04R 1/403; H04R 1/222; H04R 1/245; H04R 1/265; H04R 1/342; H04R 1/406;

(Continued)

(56) References Cited

U.S. PATENT DOCUMENTS

| | | | |
|---|---|---|---|
| 4,154,115 | A | 5/1979 | Hartung et al. |
| 4,435,986 | A | 3/1984 | Choffat |

(Continued)

FOREIGN PATENT DOCUMENTS

| | | | |
|---|---|---|---|
| CN | 103344377 | A | 10/2013 |
| KR | 10-0571967 | B1 | 4/2006 |
| WO | WO-2012/085335 | | 6/2012 |

OTHER PUBLICATIONS

International Search Report and Written Opinion, PCT/US2019/054695, Knowles Electronics, LLC (dated Jan. 23, 2020).

(Continued)

*Primary Examiner* — Fan S Tsang
*Assistant Examiner* — Julie X Dang
(74) *Attorney, Agent, or Firm* — Foley & Lardner LLP

(57) ABSTRACT

An acoustic transducer for generating electrical signals in response to acoustic signals, comprises a first diaphragm having a first corrugation formed therein. A second diaphragm has a second corrugation formed therein, and is spaced apart from the first diaphragm such that a cavity having a pressure lower than atmospheric pressure is formed therebetween. A back plate is disposed between the first diaphragm and the second diaphragm. One or more posts extend from at least one of the first diaphragm or the second diaphragm towards the other through the back plate. The one or more posts prevent each of the first diaphragm and the second diaphragm from contacting the back plate due to movement of the first diaphragm and/or the second diaphragm towards the back plate. Each of the first corrugation and the second corrugation protrude outwardly from the first diaphragm and the second diaphragm, respectively, away from the back plate.

24 Claims, 18 Drawing Sheets

(58) Field of Classification Search
CPC .... B81B 1/00; B81B 3/00; B81B 5/00; B81B 2201/00; B81B 2203/00; B81B 2207/00
USPC ..... 381/171–176, 150, 151
See application file for complete search history.

(56) References Cited

U.S. PATENT DOCUMENTS

| | | | |
|---|---|---|---|
| 6,075,867 | A | 6/2000 | Bay et al. |
| 6,431,003 | B1 | 8/2002 | Stark et al. |
| 6,435,033 | B2 | 8/2002 | Delaye |
| 6,535,460 | B2 | 3/2003 | Loeppert et al. |
| 6,571,445 | B2 | 6/2003 | Ladabaum |
| 6,662,663 | B2 | 12/2003 | Chen |
| 7,030,407 | B2 | 4/2006 | Michler |
| 7,040,173 | B2 | 5/2006 | Dehe |
| 7,124,638 | B2 | 10/2006 | Kandler |
| 7,150,195 | B2 | 12/2006 | Jacobsen et al. |
| 7,190,038 | B2 | 3/2007 | Dehe et al. |
| 7,470,546 | B2 | 12/2008 | Lehmann et al. |
| 7,473,572 | B2 | 1/2009 | Dehe et al. |
| 7,489,593 | B2 | 2/2009 | Nguyen-Dinh et al. |
| 7,535,156 | B2 | 5/2009 | Kvisteroy et al. |
| 7,545,012 | B2 | 6/2009 | Smith et al. |
| 7,781,249 | B2 | 8/2010 | Laming et al. |
| 7,793,550 | B2 | 9/2010 | Elian et al. |
| 7,795,695 | B2 | 9/2010 | Weigold et al. |
| 7,825,484 | B2 | 11/2010 | Martin et al. |
| 7,829,961 | B2 | 11/2010 | Hsiao |
| 7,856,804 | B2 | 12/2010 | Laming et al. |
| 7,903,831 | B2 | 3/2011 | Song |
| 7,918,135 | B2 | 4/2011 | Hammerschmidt |
| 8,127,619 | B2 | 3/2012 | Hammerschmidt |
| 8,339,764 | B2 | 12/2012 | Steeneken et al. |
| 8,461,655 | B2 | 6/2013 | Klein et al. |
| 8,575,037 | B2 | 11/2013 | Friza et al. |
| 8,650,963 | B2 | 2/2014 | Barr et al. |
| 8,723,277 | B2 | 5/2014 | Dehe et al. |
| 8,809,973 | B2 | 8/2014 | Theuss |
| 8,989,411 | B2 | 3/2015 | Hall et al. |
| 9,031,266 | B2 | 5/2015 | Dehe et al. |
| 9,179,221 | B2 | 11/2015 | Barzen et al. |
| 9,181,080 | B2 | 11/2015 | Dehe et al. |
| 9,237,402 | B2 | 1/2016 | Loeppert |
| 9,290,379 | B2 | 3/2016 | Theuss |
| 9,321,630 | B2 | 4/2016 | Xu et al. |
| 9,332,330 | B2 | 5/2016 | Elian et al. |
| 9,363,609 | B2 | 6/2016 | Friza et al. |
| 9,380,381 | B2 | 6/2016 | Staeussnigg |
| 9,383,282 | B2 | 7/2016 | Besling et al. |
| 9,383,285 | B2 | 7/2016 | Phan Le et al. |
| 9,425,757 | B2 | 8/2016 | Straeussnigg et al. |
| 9,432,759 | B2 | 8/2016 | Elian et al. |
| 9,438,979 | B2 | 9/2016 | Dehe |
| 9,510,107 | B2 | 11/2016 | Dehe et al. |
| 9,516,428 | B2 | 12/2016 | Dehe et al. |
| 9,549,263 | B2 | 1/2017 | Uchida |
| 9,550,211 | B2 | 1/2017 | Dirksen et al. |
| 9,631,996 | B2 | 4/2017 | Wiesbauer et al. |
| 9,689,770 | B2 | 6/2017 | Hammerschmidt |
| 9,828,237 | B2 | 11/2017 | Walther et al. |
| 9,884,757 | B2 | 2/2018 | Winkler et al. |
| 9,903,779 | B2 | 2/2018 | Hammerschmidt |
| 9,942,677 | B2 | 4/2018 | Wiesbauer et al. |
| 9,945,746 | B2 | 4/2018 | Wiesbauer et al. |
| 9,986,344 | B2 | 5/2018 | Dehe et al. |
| 9,998,812 | B2 | 6/2018 | Elian et al. |
| 10,129,676 | B2 | 11/2018 | Walther et al. |
| 10,189,699 | B2 | 1/2019 | Walther et al. |
| 10,200,801 | B2 | 2/2019 | Wiesbauer et al. |
| 10,231,061 | B2 | 3/2019 | Dehe et al. |
| 10,322,481 | B2 | 6/2019 | Dehe et al. |
| 10,433,070 | B2 | 10/2019 | Dehe et al. |
| 10,560,771 | B2 | 2/2020 | Dehe et al. |
| 10,575,101 | B2 | 2/2020 | Walther et al. |
| 10,582,306 | B2 | 3/2020 | Dehe |
| 10,589,990 | B2 | 3/2020 | Dehe et al. |
| 10,641,626 | B2 | 5/2020 | Bretthauer et al. |
| 10,648,999 | B2 | 5/2020 | Meinhold |
| 10,669,151 | B2 | 6/2020 | Strasser et al. |
| 10,676,346 | B2 | 6/2020 | Walther et al. |
| 10,689,250 | B2 | 6/2020 | Fueldner et al. |
| 10,715,926 | B2 | 7/2020 | Bretthauer et al. |
| 2005/0177045 | A1 | 8/2005 | Degertekin et al. |
| 2005/0207605 | A1 | 9/2005 | Dehe et al. |
| 2005/0219953 | A1 | 10/2005 | Bayram et al. |
| 2007/0205492 | A1* | 9/2007 | Wang ..... B81C 1/0023 257/659 |
| 2007/0278501 | A1 | 12/2007 | Macpherson et al. |
| 2008/0175425 | A1 | 7/2008 | Roberts et al. |
| 2008/0267431 | A1 | 10/2008 | Leidl et al. |
| 2008/0279407 | A1 | 11/2008 | Pahl |
| 2008/0283942 | A1 | 11/2008 | Huang et al. |
| 2009/0001553 | A1 | 1/2009 | Pahl et al. |
| 2009/0180655 | A1 | 7/2009 | Tien et al. |
| 2010/0046780 | A1 | 2/2010 | Song |
| 2010/0052082 | A1 | 3/2010 | Lee et al. |
| 2010/0128914 | A1 | 5/2010 | Khenkin |
| 2010/0170346 | A1 | 7/2010 | Opitz et al. |
| 2010/0173437 | A1 | 7/2010 | Wygant et al. |
| 2010/0183181 | A1 | 7/2010 | Wang |
| 2010/0246877 | A1 | 9/2010 | Wang et al. |
| 2010/0290644 | A1 | 11/2010 | Wu et al. |
| 2010/0322443 | A1 | 12/2010 | Wu et al. |
| 2010/0322451 | A1 | 12/2010 | Wu et al. |
| 2011/0013787 | A1 | 1/2011 | Chang |
| 2011/0075875 | A1 | 3/2011 | Wu et al. |
| 2013/0001550 | A1 | 1/2013 | Seeger et al. |
| 2014/0071642 | A1 | 3/2014 | Theuss |
| 2015/0090043 | A1 | 4/2015 | Ruhl et al. |
| 2015/0247879 | A1 | 9/2015 | Meinhold |
| 2015/0296307 | A1 | 10/2015 | Shao et al. |
| 2016/0066099 | A1 | 3/2016 | Dehe et al. |
| 2016/0096726 | A1 | 4/2016 | Dehe et al. |
| 2018/0091906 | A1* | 3/2018 | Khenkin ..... H04R 31/003 |
| 2018/0234774 | A1* | 8/2018 | Walther ..... B81B 3/0021 |
| 2018/0317022 | A1 | 11/2018 | Evans et al. |
| 2019/0112182 | A1 | 4/2019 | Metzger-Brueckl et al. |
| 2019/0181776 | A1 | 6/2019 | Tumpold et al. |
| 2019/0246459 | A1 | 8/2019 | Tumpold et al. |
| 2019/0255669 | A1 | 8/2019 | Dehe et al. |
| 2019/0270639 | A1 | 9/2019 | Lorenz et al. |
| 2019/0331531 | A1 | 10/2019 | Glacer et al. |
| 2019/0339193 | A1 | 11/2019 | Eberl et al. |
| 2019/0352175 | A1 | 11/2019 | Tumpold et al. |
| 2019/0363757 | A1 | 11/2019 | Mikolajczak et al. |
| 2020/0057031 | A1 | 2/2020 | Theuss et al. |
| 2020/0216309 | A1 | 7/2020 | Fueldner et al. |
| 2020/0239302 | A1 | 7/2020 | Strasser et al. |

OTHER PUBLICATIONS

Andrews et al., "A comparison of squeeze-film theory with measurements on a microstructure," Industrial Research Ltd., Mar. 24, 1992, 9 pages.

Bay et al., "Design of a silicon microphone with differential read-out of a sealed double parallel-plate capacitor," Sensors and Acutators A 53 (1996), pp. 232-236, 5 pages.

Hansen et al., "Wideband micromachined capacitive microphones with radio frequency detection," Edward L. Ginzton Laboratory, Stanford University, Stanford, California, May 21, 2004, pp. 828-842, 15 pages.

Lin, Der-Song, "Interface Engineering of Capacitive Micromachined Ultrasonic Transducers for Medical Applications," A Dissertation Submitted to the Department of Mechanical Engineering and the Committee on Graduate Studies of Stanford University in Partial Fulfillment of the Requirements for the Degree of Doctor of Philosophy, Jun. 2011, 168 pages.

Park et al., "Fabrication of Capacitive Micromachined Ultrasonic Transducers via Local Oxidation and Direct Water Bonding," Journal of Microelectromechanical Systems, vol. 20, No. 1, Feb. 2011, 10 pages.

(56) References Cited

OTHER PUBLICATIONS

Unknown, "Smart Sensors for Industrial Applications," Figure 19. 1, p. 306, 1 page (2013).
Wygant et al., "50 kHz Capacitive Micromachined Ultrasonic Transducers for Generation of Highly Directional Sound with Parametric Arrays," IEEE Transactions on Ultrasonics, Ferroelectrics, and Frequency Control, vol. 56, No. 1, Jan. 2009, pp. 193-203, 11 pages.

* cited by examiner

ACOUSTIC TRANSDUCERS WITH A LOW PRESSURE ZONE AND DIAPHRAGMS HAVING ENHANCED COMPLIANCE

CROSS-REFERENCE TO RELATED APPLICATIONS

The present application claims priority to and benefit of U.S. Provisional Application No. 62/742,153, filed Oct. 5, 2018, the entire disclosure of which is hereby incorporated by reference herein.

TECHNICAL FIELD

The present disclosure relates generally to systems and methods of improving compliance of diaphragms included acoustic transducers.

BACKGROUND

Microphone assemblies are generally used in electronic devices to convert acoustic energy to electrical signals. Microphones generally include diaphragms for converting acoustic signals to electrical signals. Pressure sensors may also include such diaphragms. Advancements in micro and nanofabrication technologies have led to the development of progressively smaller micro-electro-mechanical-system (MEMS) microphone assemblies and pressure sensors.

SUMMARY

Embodiments described herein relate generally to systems and methods for increasing compliance in a top and bottom diaphragm of a dual diaphragm acoustic transducer and/or prevent collapse of either or both diaphragms. In particular, some embodiments described herein relate to dual diaphragm acoustic transducers that include one or more outward facing corrugations defined in the diaphragms for increasing compliance and/or one or more non-rigidly connected or unanchored posts extending from at least one of the dual diaphragms to the other so as to serve as stoppers for preventing collapse of the dual diaphragms.

In some embodiments, an acoustic transducer for generating electrical signals in response to acoustic signals comprises: a first diaphragm having a first corrugation formed therein, and a second diaphragm having a second corrugation formed therein. The second diaphragm is spaced apart from the first diaphragm such that a cavity is formed therebetween, the cavity having a pressure lower than atmospheric pressure. A back plate is disposed in the cavity between the first diaphragm and the second diaphragm. One or more post extend from at least one of the first diaphragm or the second diaphragm towards the other of the first diaphragm or the second diaphragm through a corresponding aperture defined in the back plate. The one or more posts are configured to prevent each of the first diaphragm and the second diaphragm from contacting the back plate due to movement of the first diaphragm and/or the second diaphragm towards the back plate. Each of the first corrugation and the second corrugation protrude outwardly from the first diaphragm and the second diaphragm, respectively, in a direction away from the back plate.

In some embodiments, a microphone assembly comprises a base, and a lid positioned on the base. A port is defined in one of the base or the lid. An acoustic transducer is positioned on the base or the lid and separates a front volume from a back volume of the microphone assembly, the front volume being in fluidic communication with the port. The acoustic transducer comprises first diaphragm having a first corrugation formed therein, a second diaphragm having a second corrugation formed therein, the second diaphragm spaced apart from the first diaphragm such that a cavity is formed therebetween, the cavity having a pressure lower than atmospheric pressure. A back plate is disposed in the cavity between the first diaphragm and the second diaphragm. One or more posts extend from at least one of the first diaphragm or the second diaphragm towards the other of the first diaphragm or the second diaphragm through a corresponding aperture defined in the back plate, the one or more posts configured to prevent each of the first diaphragm and the second diaphragm from contacting the back plate due to movement of the first diaphragm and/or the second diaphragm towards the back plate. Each of the first corrugation and the second corrugation protrude outwardly from the first diaphragm and the second diaphragm, respectively, in a direction away from the back plate. An integrated circuit is electrically coupled to the acoustic transducer, the integrated circuit configured to measure a change in capacitance between the first diaphragm and the back plate, and the second diaphragm and the back plate in response to receiving an acoustic signal through the port, the change in capacitance corresponding to the acoustic signal.

In some embodiments, an acoustic transducer for generating electrical signals in response to acoustic signals comprises a first diaphragm having a first corrugation formed therein. A second diaphragm has a second corrugation formed therein, the second diaphragm spaced apart from the first diaphragm such that a cavity is formed therebetween, the cavity having a pressure lower than atmospheric pressure. A back plate is disposed in the cavity between the first diaphragm and the second diaphragm. One or more posts extend from at least one of the first diaphragm or the second diaphragm towards the other of the first diaphragm or the second diaphragm through a corresponding aperture defined in the back plate, the one or more posts configured to prevent each of the first diaphragm and the second diaphragm from contacting the back plate due to movement of the first diaphragm and/or the second diaphragm towards the back plate. A peripheral support structure is attached to and supports at least a portion of a periphery of the first diaphragm and the second diaphragm, the peripheral support structure located proximate to an edge of the first and second diaphragms. The acoustic transducer also includes a substrate defining a first opening therein. A support structure is disposed on the substrate and defines a second opening corresponding to the first opening of the substrate, at least a portion of the first diaphragm is disposed on the support structure. Each of the first corrugation and the second corrugation protrude outwardly from the first diaphragm and the second diaphragm, respectively, in a direction away from the back plate.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1A:
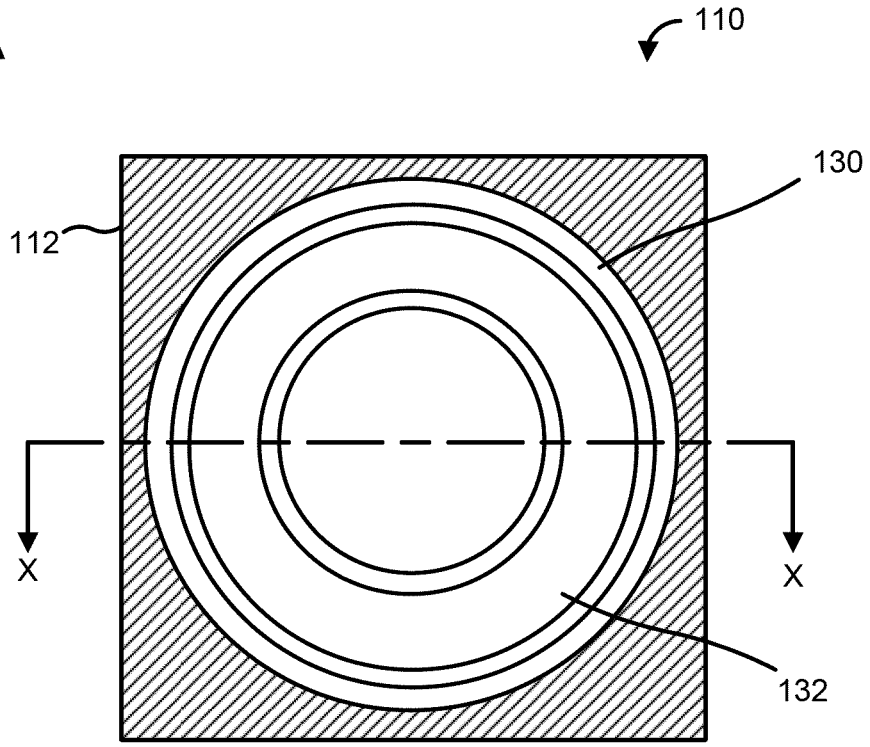
FIG. 1A is a plan view of an acoustic transducer and FIG. 1B is a side cross-section view of the acoustic transducer of FIG. 1A taken along the line X-X shown in FIG. 1A, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to systems and methods for increasing compliance in a top and bottom diaphragm of a dual diaphragm acoustic transducer and/or prevent collapse of either or both diaphragms. In particular, some embodiments described herein relate to dual diaphragm acoustic transducers that include one or more outward facing corrugations defined in the diaphragms for increasing compliance and/or one or more non-rigidly connected or unanchored posts extending from at least one of the dual diaphragms to the other so as to serve as stoppers for preventing collapse of the dual diaphragms.

Dual diaphragm acoustic transducers include a top diaphragm and a bottom diaphragm with a back plate interposed therebetween. The diaphragms can be sealed under reduced pressure so as to create a low pressure region between the top and bottom diaphragm which has a pressure substantially lower than atmospheric pressure, for example, medium vacuum in a range of approximately 1 mTorr to 10 Torr may be sufficient in many cases. The low pressure region substantially reduces acoustic damping of the back plate (i.e., squeeze film damping) allowing reduction in a gap between the diaphragms and a back plate, reduction in perforations and may allow very high sensing capacitance. Furthermore, since the volume between the top and bottom diaphragms is sealed, particles (e.g., dust, water droplets, solder or assembly debris, etc.) cannot penetrate between the diaphragms and the back plate, which is a common cause of failure in single diaphragm acoustic transducers. Thus, protective meshes or membranes that are used to prevent egress of such particles into single diaphragm acoustic transducers but reduce signal to noise ratio (SNR) may be eliminated in some dual diaphragm acoustic transducer implementations disclosed herein.

A main challenge in dual diaphragm acoustic transducers is achieving sufficient compliance in the diaphragms. Atmospheric pressure acting on each of the diaphragms creates tension in the diaphragms causing significant reduction in compliance. Furthermore, a sufficiently larger pressure difference between atmospheric pressure and the low pressure zone between the two diaphragms may cause collapse of the diaphragms, leading to failure of the acoustic transducer.

In contrast, embodiments of the acoustic transducers described herein may provide benefits including, for example: (1) providing outward facing corrugations/corrugations on each of a top and bottom diaphragm of the acoustic transducer so as to increase an average compliance in a diaphragm region of the acoustic transducer; (2) preventing collapse of the first diaphragm and the second diaphragm towards each other by providing non-rigidly connected and/or unanchored posts protruding from at least one of the diaphragm towards the other which serves as stoppers; (3) increasing robustness of the diaphragms; and (4) providing an increase in compliance (e.g., of more than 8 times at 100 kPa differential pressure) relative to a similar acoustic transducer that does not include such corrugations.

As described herein, the term "unanchored" when used in conjunction with posts refers to posts which extend from one diaphragm to another diaphragm of a dual diaphragm acoustic transducer such that a gap or space exists between a tip of the post and the respective diaphragm proximate to the tip. Contact of the tip with the respective diaphragm is only made when a sufficiently high force or pressure acts on one or both the diaphragms (e.g., ambient pressure or electrostatic force due to bias) such that the unanchored posts can both slide and rotate relative to the respective diaphragm.

As described herein, the term "non-rigidly connected" when used in conjunction with posts refers to posts which extend from one diaphragm to another diaphragm of a dual diaphragm acoustic transducer such that a tip of the post is in permanent contact with the opposing diaphragm so as to allow bending or rotation of the post near or proximate to the point of contact.

As described herein, the term "anchored" when used in conjunction with posts refers to posts including a tip which is in contact with an opposing diaphragm such that the anchored post is immovable relative to the opposing diaphragm.

Figure 1B:
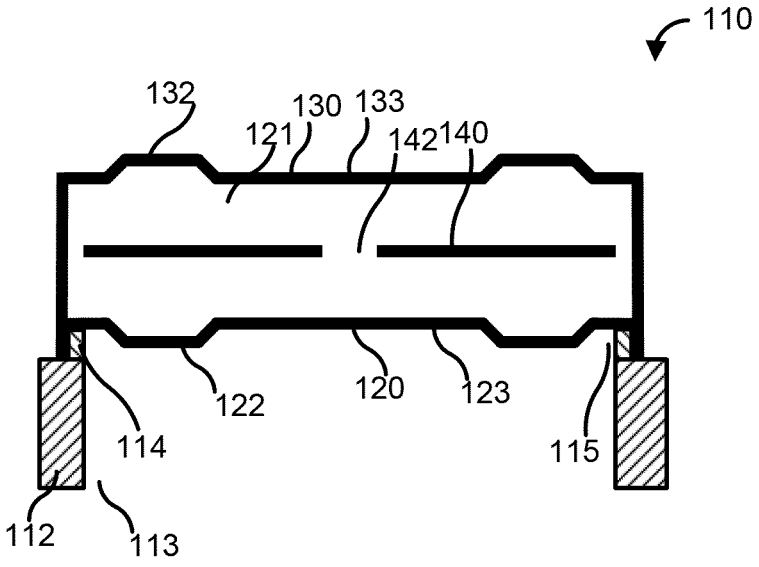

FIG. 1A is a plan view of an acoustic transducer 110, according to an embodiment. FIG. 1B is a side cross-section view of the acoustic transducer 110 taken along the line X-X in FIG. 1A. The acoustic transducer 110 may include, for example, a MEMS acoustic transducer for use in a MEMS microphone assembly, a MEMS pressure sensor, or combinations thereof. The acoustic transducer 110 is configured to generate electrical signals responsive to acoustic signals or atmospheric pressure changes.

The acoustic transducer 110 includes a substrate 112 defining a first opening 113 therein. In some embodiments, the substrate 112 may be formed from silicon, glass, ceramics, or any other suitable material. A support structure 114 is disposed over the substrate 112 and defines a second opening 115 which may be axially aligned with the first opening 113. In various embodiments, the support structure 114 may be formed from glass (e.g., glass, or glass having a phosphorus content such as PSG). In some embodiments, the openings 113 and 115 may have the same cross-section (e.g., the same diameter). In other embodiments, the openings 113 and 115 may have different cross-sections (e.g., different diameters).

The acoustic transducer 110 includes a bottom or first diaphragm 120, a top or second diaphragm 130 and a back plate 140 located between the first diaphragm 120 and the second diaphragm 130. Each of the first diaphragm 120, the second diaphragm 130 and the back plate 140 are disposed on the substrate 112. At least a portion of the first diaphragm 120 may be disposed on the support structure. In some embodiments, a portion of radial edges of one or more of the first diaphragm 120, the second diaphragm 130 and the back plate 140 may be embedded within the support structure 114 during a fabrication process of the acoustic transducer 110 such that forming the second opening 115 in the support structure 114 causes each of the first diaphragm 120, the second diaphragm 130 and the back plate 140 to be suspended in the second opening 115 over the first opening 113.

The diaphragms 120 and 130 may be formed from a conductive material or a sandwiched layer of conductive and insulative materials. Materials used for forming the diaphragms 120 an 130 may include, for example, silicon, silicon oxide, silicon nitride, silicon carbide, gold, aluminum, platinum, etc. Vibrations of the diaphragms 120, 130 (e.g., out of phase vibrations) relative to the back plate 140 which is substantially fixed (e.g., substantially inflexible relative to the diaphragms 120, 130) in response to acoustic signals received on one of the first or second diaphragms 120 and 130 causes changes in the capacitance between the diaphragms 120 and 130, and the back plate 140, and corresponding changes in the generated electrical signal.

In other embodiments, at least a portion of the first diaphragm 120 and the second diaphragm 130 may be formed using a piezoelectric material, for example, quartz, lead titanate, III-V and II-VI semi-conductors (e.g., gallium nitride, indium nitride, aluminum nitride, zinc oxide, etc.), graphene, ultra nanocrystalline diamond, polymers (e.g., polyvinylidene fluoride) or any other suitable piezoelectric material. For example, the piezoelectric material may be deposited as a ring around the first or second diaphragm 120 or 130 perimeter on top of the base material forming the diaphragms 120 and 130 (e.g., silicon nitride or polysilicon). In such embodiments, vibration of the diaphragms 120, 130 in response to the acoustic signal may generate an electrical signal (e.g., a piezoelectric current or voltage) which is representative of the acoustic signal. When operated as a pressure sensor, inwards displacement of the each of the diaphragms 120 and 130 towards each other with increasing ambient pressure or outwards displacement away from each other with decreasing ambient pressure generates an electrical signal corresponding to the atmospheric pressure. In various embodiments, the first and second diaphragms 120, 130 may be formed from low stress silicon nitride (LSN), or any other suitable material (e.g., silicon oxide, silicon, silicon carbide, ceramics, etc.). Furthermore, the back plate 140 may be formed from polysilicon (poly) and silicon nitride, or any other suitable material (e.g., silicon oxide, silicon, ceramics, etc.).

Outer surfaces 123 and 133 of each of the first diaphragm 120 and the second diaphragm 130 are exposed to atmosphere, for example, atmospheric air. The second diaphragm 130 is spaced apart from the first diaphragm 120 such that a cavity or volume 121 is formed between the first and second diaphragms 120 and 130. The cavity 121 has a pressure which is lower than atmospheric pressure, for example, in a range of 1 mTorr to 10 Torr, but in some embodiments, limiting the pressure to be in a range of 1 mTorr to 1 Torr may provide particular benefits in terms of signal to noise ratio (SNR). The back plate 140 is disposed in the cavity 121 between the first and second diaphragms 120 and 130. In some embodiments, one or more apertures 142 may be defined in the back plate 140 such that a portion of the cavity 121 located between the first diaphragm 120 and the back plate 140 is connected to a portion of the cavity 121 located between the second diaphragm 130 and the back plate 140.

The large pressure differential between the atmospheric pressure acting on each of the first diaphragm 120 and the second diaphragm 130, and the low pressure in the cavity 121 causes the first diaphragm 120 and the second diaphragm 130 to be in a state of continuous tension. This significantly reduces the compliance of the diaphragms 120, 130. To increase compliance, a first corrugation 122 and a second corrugation 132 is formed on the first diaphragm 120 and the second diaphragm 130, respectively. The first and second corrugation 122, 132 protrude outwardly from the diaphragms 120 and 130, respectively in a direction away from the back plate 140.

For example, the diaphragms 120, 130 may include one or more circumferential corrugations (as best shown in FIG.

1B) that serve to decrease tension in the first and second diaphragm 120 and 130, respectively and increase compliance. While shown as including a single corrugation 122, 132, any number of corrugations may be formed in the first and second diaphragm 120 and 130 (e.g., 2, 3 or even more corrugations located circumferentially about a longitudinal axis of the acoustic transducer 110). In various embodiments, the corrugations 122 and 132 may have a height in a range of 0.5 microns to 5 microns (e.g., 0.5, 1, 2, 3, 4 or 5 microns inclusive of all ranges and values therebetween), and a spacing between the diaphragms 120 and 130 may be in a range of 1-15 microns (e.g., 1, 3, 5, 7, 9, 12, 14 or 15 microns inclusive of all ranges and values therebetween).

Atmospheric air exerts a force on each of the first and second diaphragms 120 and 130 in a direction towards the back plate 140. Since the corrugations 122 and 132 protrude outwards from the diaphragms 120 and 130, the atmospheric pressure acting on the corrugations 122 and 132 causes the corrugations to flex axially inwards towards the back plate 140 and radially outwards. This causes an increase in compliance which increases proportionally with a relative increase in atmospheric pressure. For example, in some implementations, the acoustic transducer 110 may have an acoustic compliance in the region of the diaphragms 120 and 130 which is about 2 times an acoustic compliance of a similar baseline acoustic transducer that does not include the outward protruding corrugations 122 and 132 at a pressure differential of about zero between atmospheric pressure and the pressure in the cavity 121. The compliance of the acoustic transducer 110 may increase to greater than 8 times the acoustic compliance of the baseline acoustic transducer at a pressure differential of about 100 kPa, which corresponds to a greater than 13 dB increase in acoustic compliance. In this manner, the acoustic transducer 110 has significantly higher sensitivity towards acoustic signals, or for measuring pressure changes relative to the baseline acoustic transducer.

In some embodiments, the acoustic transducer 110 or any other acoustic transducer described herein may be operated as a microphone and/or a pressure sensing assembly. In such embodiment, atmospheric pressure acts on both the diaphragms 120 and 130, and acoustic pressure acts on one of the diaphragms (e.g., either one of the diaphragms 120 or 130). Changes in atmospheric pressure cause the capacitance values of each of the diaphragms 120 and 130 to change in the same direction which creates a common mode signal which is used for pressure sensing. On the contrary, acoustic pressure causes the two capacitance values to change in opposite directions creating a differential mode signal which is used to sense the acoustic pressure.

Figure 2A:
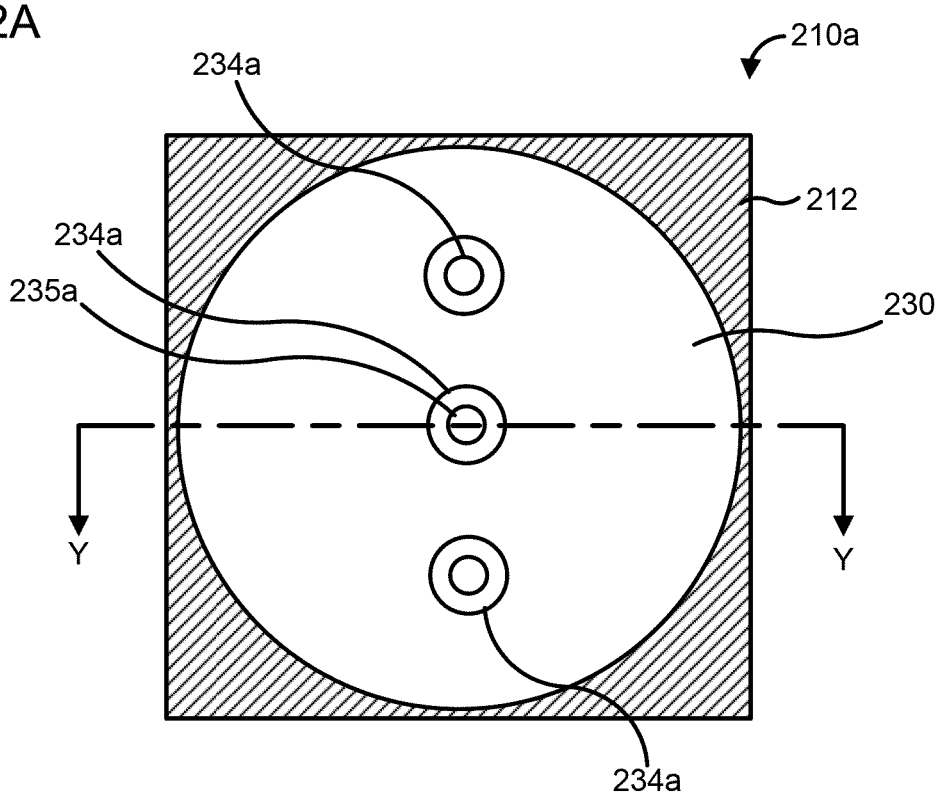
FIG. 2A is a plan view of an acoustic transducer and FIG. 2B is a side cross-section view of the acoustic transducer of FIG. 2A taken along the line Y-Y shown in FIG. 2A, according to an embodiment.
Figure 2B:
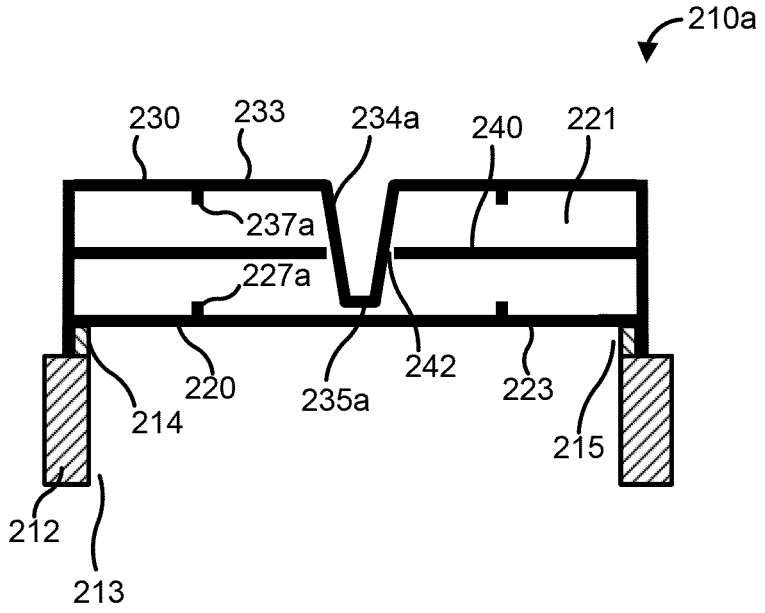

FIG. 2A is a plan view of an acoustic transducer 210*a*, according to an embodiment. FIG. 2B is a side cross-section view of the acoustic transducer 210*a* taken along the line Y-Y in FIG. 2A. The acoustic transducer 210*a* may include, for example, a MEMS acoustic transducer for use in a MEMS microphone assembly or a MEMS pressure sensor. The acoustic transducer 210*a* is configured to generate electrical signals in response to acoustic signals or atmospheric pressure changes.

The acoustic transducer 210*a* includes a substrate 212 defining a first opening 213 therein. A support structure 214 is disposed over the substrate 212 and defines a second opening 215 which may be axially aligned with the first opening 213. The substrate 212 and the support structure 214 may be substantially similar to the substrate 112 and the support structure 114, and therefore are not described in further detail herein.

The acoustic transducer 210*a* includes a bottom or first diaphragm 220, a top or second diaphragm 230 and a back plate 240 located between the first diaphragm 220 and the second diaphragm 230. Each of the first diaphragm 220, the second diaphragm 230 and the back plate 240 may be formed from the same materials as the first diaphragm 120, the second diaphragm 130 and the back plate 140. Outer surfaces 223 and 233 of each of the first diaphragm 220 and the second diaphragm 230 are exposed to atmosphere, for example, atmospheric air. Furthermore, a cavity 221 between the first and second diaphragms 220 and 230 is at a pressure which is lower than atmospheric pressure, for example, in a range of 1 mTorr to 10 Torr, but in some embodiments, limiting the pressure to be in a range of 1 mTorr to 1 Torr may provide particular benefits in terms of signal to noise ratio (SNR). One or more apertures 242 may be defined in the back plate 240 such that a first portion of the cavity 221 located between the first diaphragm 220 and the back plate 240 is connected to a second portion of the cavity 221 between the second diaphragm 230 and the back plate 240.

The large pressure differential between atmospheric pressure acting on each of the first diaphragm 220 and the second diaphragm 230 and the low pressure in the cavity 221 may become sufficiently large so as to cause the first and second diaphragm 220 and 230 to collapse. In order to prevent this from occurring, the second diaphragm 230 includes one or more posts 234*a* extending therefrom towards the first diaphragm 220 through a corresponding aperture 242 or any other aperture defined in the back plate 240, a portion of the post 234*a* configured to contact the first diaphragm 220 in response to movement of the second diaphragm 230 towards the first diaphragm 220 or vice versa. For example, a tip 235*a* of the post 234*a* is positioned proximate to the first diaphragm 220 and spaced apart therefrom such that the post 234*a* is an unanchored post. In other words, the tip 235*a* of the post 234*a* does not contact the first diaphragm 220 at some pressure differentials, but may touch the first diaphragm 220 at other pressure differentials to prevent collapse of the diaphragms 220 and 230. In some embodiments, a default spacing (e.g., when a pressure difference between a pressure inside the cavity 221 and a pressure of the exterior environment is about zero) between the tip 235*a* and the post 234*a* may be in a range of 10 nm to 2 microns. In some embodiments, one or more unanchored posts may additionally or alternatively extend from the first diaphragm 220 towards the second diaphragm 230.

When one or both of the diaphragms 220, 230 are displaced (e.g., bent) towards each other due to ambient pressure loading or other loading force (e.g. electrostatic force), the tip 235*a* of the post 234*a* contacts an inner surface of the first diaphragm 220 located within the cavity 221 so as to restrict further displacement of the diaphragms 220, 230 towards each other, at least at the locations of the diaphragms 220 and 230 where the post 234*a* is positioned. In other words, the post 234*a* serves as a stopper or a motion limiter which limits displacement of the diaphragms 220 and 230 towards the back plate 240, for example, due to static deformation of the first diaphragms 220 and/or the second diaphragm 230 towards the back plate 240 because of a large pressure difference between the cavity 221 and the exterior environment and/or vibration of the diaphragms 220, 230. The portions of the diaphragms 220, 230 between adjacent posts 234*a* or between the post 234*a* and the support structure 214 may still displace towards each other, but the small radial length of these portions may restrict the displacement so as to prevent collapse.

In some embodiments, overpressure stops or ridges may be included in the regions between the posts 234*a* to prevent electrical shorting if one or both of the diaphragms 220 or 230 deflects sufficiently to contact the back plate 240. For example, as shown in FIG. 2A, a first set of pillars 227*a* extend from the first diaphragm 220 towards the back plate 240 and a second set of pillars 237*a* extend from the second diaphragm towards the back plate 240. The pillars 227*a*, 237*a* are formed from a non-conductive material (e.g., silicon oxide or silicon nitride) to prevent electrical shorting in scenarios where atmospheric pressure is sufficiently high to cause the first diaphragm 220 and/or the second diaphragm 230 to contact the back plate 240. While shown as pillars 227*a*, 237*a*, in other embodiments, the overpressure stops may include bumps or dimples defined on the first and/or the second diaphragms 220 and 230. Moreover, overpressure stops may also be formed in the back plate 240. Alternatively, the pillars 227*a*, 237*a* may be formed of conductive material (e.g. doped poly-silicon, metal, etc.) if the contact region is non-conductive (e.g. an opening in the electrode). It should be understood that while FIG. 2A shows the posts 234*a* being vertically aligned with each other, in other embodiments, the posts 234*a* may be misaligned, staggered or disposed at any other suitable location relative to each other. Moreover, while FIG. 2A shows only three posts 234*a* the acoustic transducer 210*a* or any other acoustic transducer defined herein that includes may include a plurality of posts, for example, greater than 10, 20, 30, 40, 50 posts inclusive of all ranges and values therebetween. Furthermore, while described as a "post," the posts 234*a* may include any suitable structure configured to provide separation of the first diaphragm 320 and the second diaphragm 330 from the back plate 340.

Figure 2C:
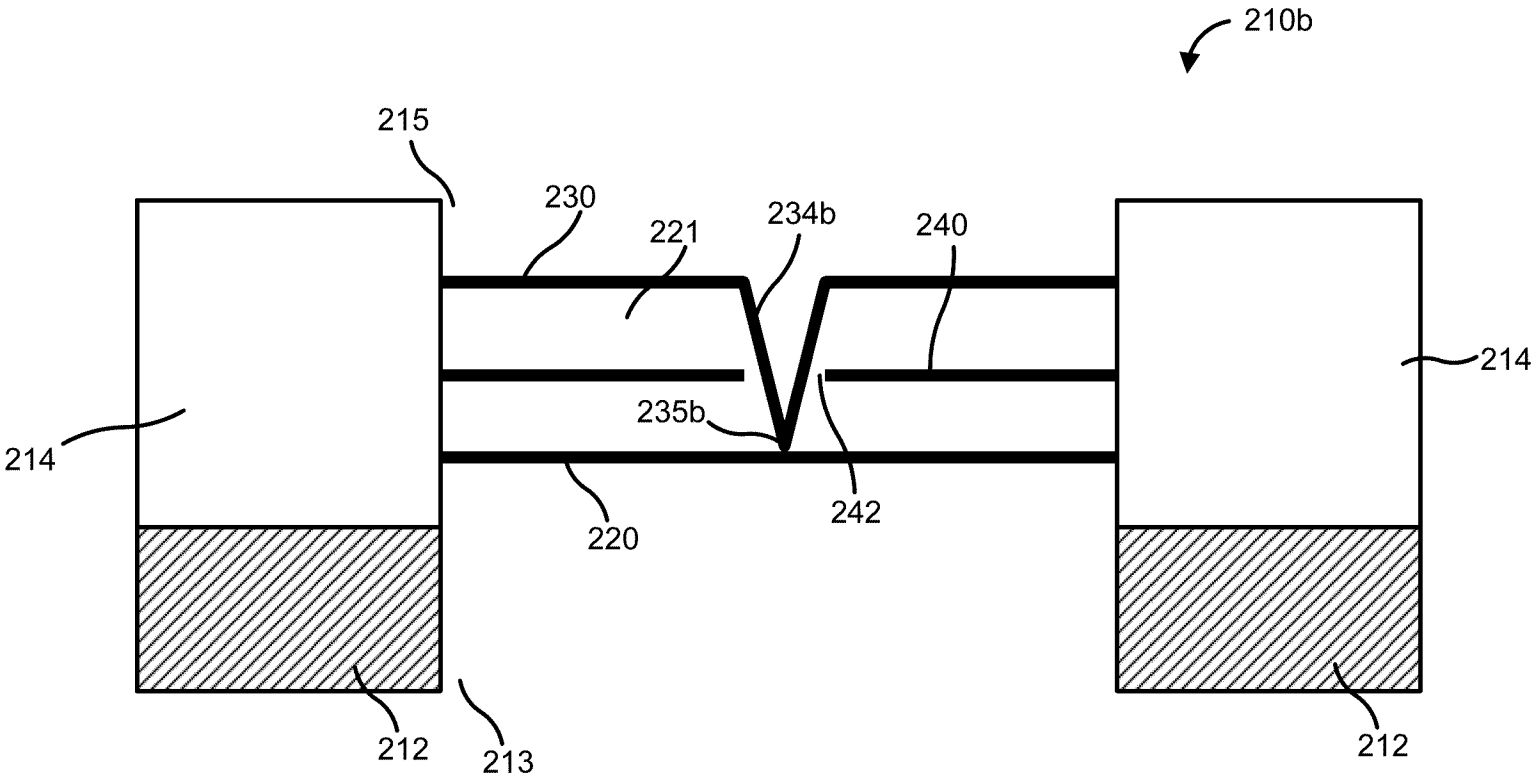
FIGS. 2C-2E are schematic illustrations of acoustic transducers, according to various embodiments.

FIG. 2C is a schematic illustration of an acoustic transducer 210*b*, according to another embodiment. The acoustic transducer 210*b* is substantially similar to the acoustic transducer 210*a*, apart from the following differences. A post 234*b* extends from the second diaphragm 230 towards the first diaphragm 220. A tip 235*b* of the post 234*b* is positioned in contact with the first diaphragm 220. The shape of the post 234*b* is such that it is narrow at or near the connection point (e.g., forms a cone shape) so to allow rotation or bending of the post relative to the first diaphragm 220 at or near the connection point, i.e., at the tip 235*b* of the post 234*b*. The post 234*b* is hence a non-rigidly connected post. In some embodiments, one or more non-rigidly connected posts may additionally or alternatively extend from the first diaphragm 220 towards the second diaphragm 230.

Figure 2D:
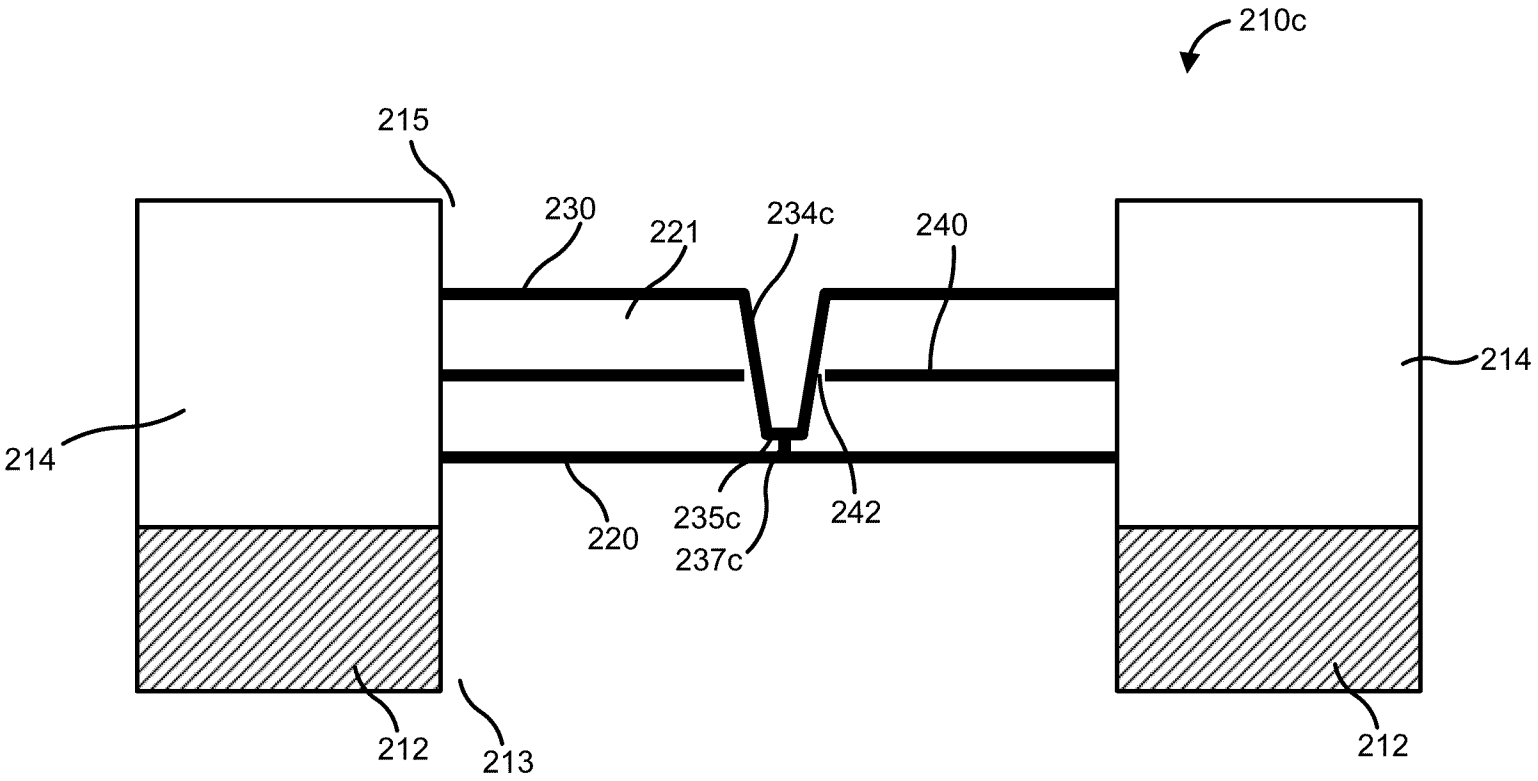

FIG. 2D is a schematic illustration of an acoustic transducer 210*c*, according to yet another embodiment. The acoustic transducer 210*c* is substantially similar to the acoustic transducer 210*a/b*, with the exception that a post 234*c* extending from the second diaphragm 230 towards the first diaphragm 220 includes a flat tip 235*c* which is spaced apart from the first diaphragm 220 (e.g., the post 234*c* may be shaped as a truncated cone). A protrusion 237*c* (e.g., a pin) extends from the tip 235*c* and contacts the first diaphragm 220 such that the post 234*c* may rotate or bend at one near the connection point, and is therefore non-rigidly connected to the first diaphragm 220.

Figure 2E:
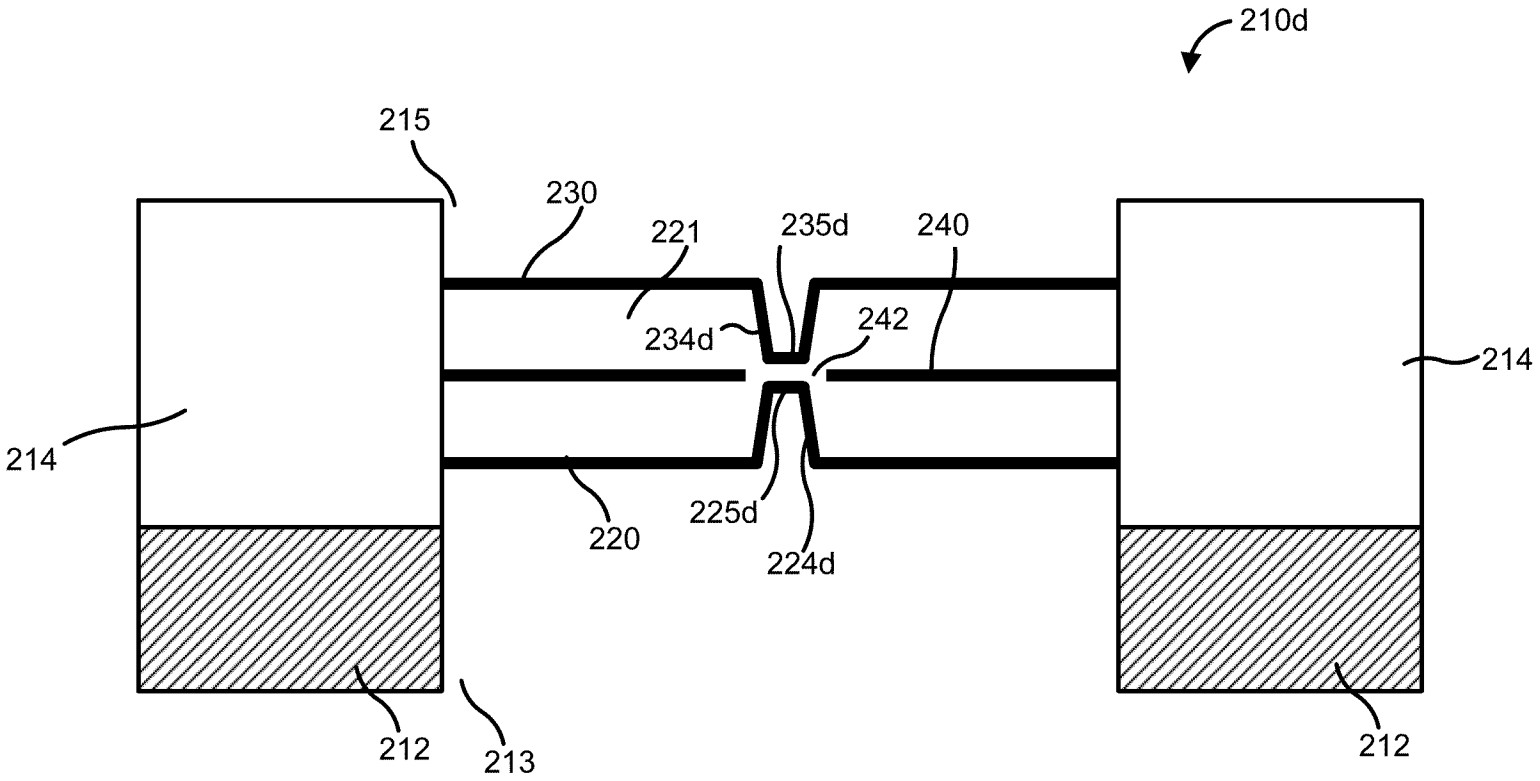

FIG. 2E is a schematic illustration of an acoustic transducer 210*d*, according to yet another embodiment. The acoustic transducer 210*d* is substantially similar to the acoustic transducer 210*a*, apart from the following differences. A first post 224*d* extends from the first diaphragm 220 towards the second diaphragm 230 and includes a flat tip 225*d* (e.g., is shaped as a truncated cone). Furthermore, a second post 234*d* extends from the second diaphragm 230 towards the first post 224*d*. The second post 234*d* also includes a flat tip 235*d*. The tips 225*d*/235*d* are positioned proximate to each other but do not contact each other, i.e., are unanchored posts. The tips 225*d* and 235*d* of the posts 224*d* and 234*d*, respectively may contact each other in response to movements of the diaphragms 220 and 230 towards each other. In some embodiments, the first and second posts 224*d* and 234*d* may be substantially similar in size and shape to each other.

Figure 2F:
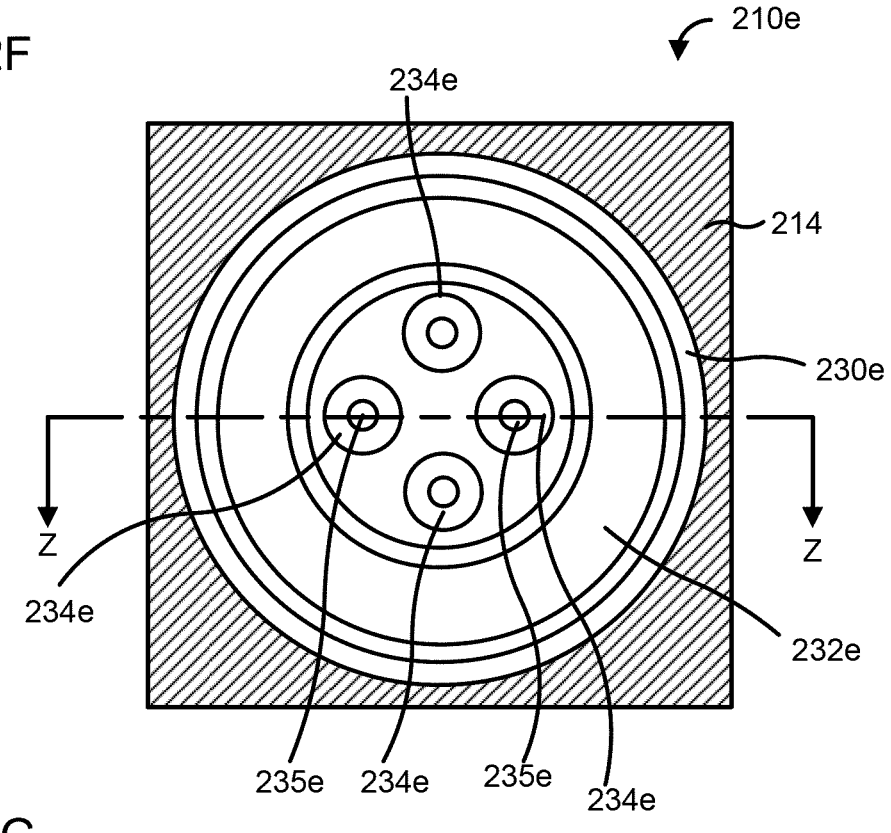
FIG. 2F is a plan view of an acoustic transducer and FIG. 2G is a side cross-section view of the acoustic transducer of FIG. 2F taken along the line Z-Z shown in FIG. 2F, according to yet another embodiment.
Figure 2G:
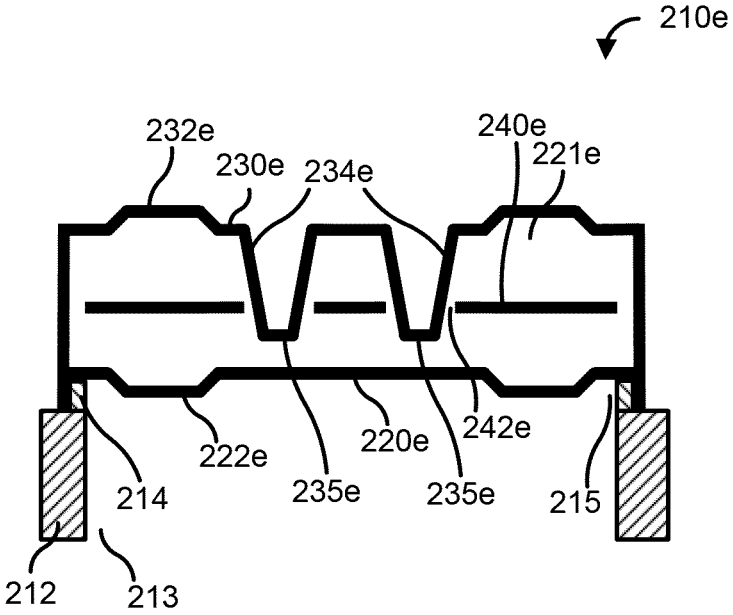

FIG. 2F is a plan view of an acoustic transducer 210*e*, according to still another embodiment. FIG. 2G is a side cross-section view of the acoustic transducer 210*e* taken along the line Z-Z in FIG. 2F. The acoustic transducer 210*e* includes the substrate 212 and the support structure 214. The acoustic transducer 210*e* also includes a first diaphragm 220*e* having a first corrugation 222*e* formed therein, and a second diaphragm 230*e* having a second corrugation 232*e* formed therein. The second diaphragm 230*e* is spaced apart from the first diaphragm 220*e* such that a cavity 221*e* is formed therebetween. The cavity 221*e* has a pressure lower than atmospheric pressure (e.g., in a range of 1 mTorr to 10 Torr, or 1 mTorr to 1 Torr). A back plate 240*e* is disposed in the cavity 221*e* between the first diaphragm 220*e* and the second diaphragm 230*e*.

Each of the first corrugation 222*e* and the second corrugation 232*e* protrude outwardly from the first diaphragm 220*e* and the second diaphragm 230*e*, respectively. As shown in FIG. 2G, the corrugations 222*e* and 232*e* are enclosed circumferential structures disposed about a longitudinal axis of the acoustic transducer 210*e* along which the diaphragms 220*e* and 230*e* vibrate. Posts 234*e* extend from the second diaphragm 230*e* towards the first diaphragm 220*e* through corresponding apertures 242*e* defined in the back plate 240. Tips 235*e* of the posts 234*e* are configured to contact the first diaphragm 220*e* in response to movement of the second diaphragm 230*e* towards the first diaphragm 220*e* or vice versa. Thus, the posts 234*e* are unanchored. As shown in FIG. 2G, the posts 234*e* are point structures. While shown as including four posts 234*e*, any number of posts can be provided in the first and/or second diaphragms 220*e* and 230*e*. Out of plane posts 234*e* are not shown in FIG. 2G for clarity. Furthermore, the first and/or second diaphragms 220*e* and 230*e* may also include non-rigidly connected posts and/or anchored posts.

Figure 3A:
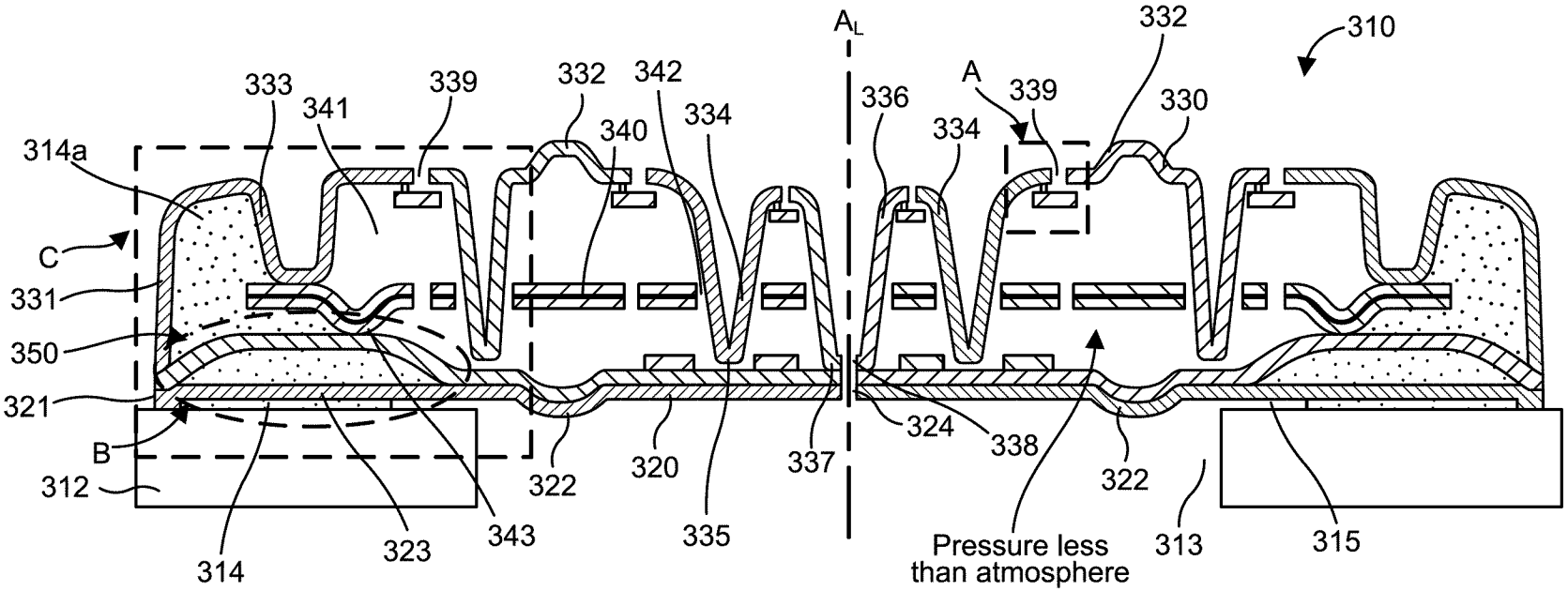
FIG. 3A is a side cross-section view of an acoustic transducer, according to yet another embodiment.
Figure 3B:
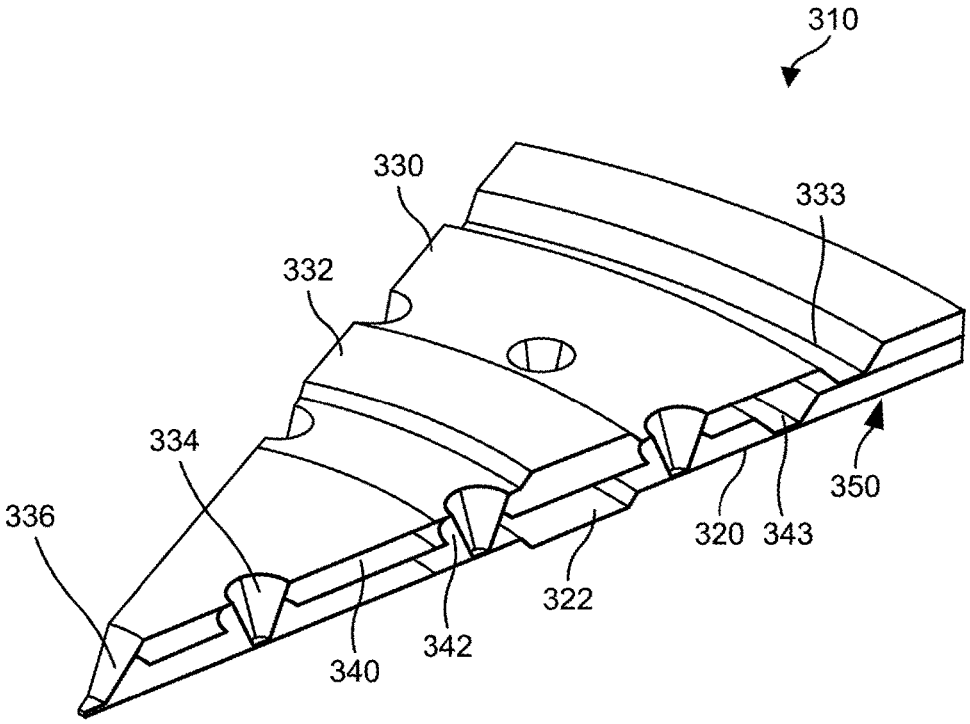
FIG. 3B is a top isometric view of a portion of the acoustic transducer of FIG. 3A.

FIG. 3A is a side cross-section view of an acoustic transducer 310, according to still another embodiment. FIG. 3B is a top isometric view of a portion of the acoustic transducer 310. The acoustic transducer 310 may include, for example, a MEMS acoustic transducer for use in a MEMS microphone assembly or a MEMS pressure sensor. The acoustic transducer 310 is configured to generate electrical signals in response to acoustic signals or atmospheric pressure changes.

The acoustic transducer 310 includes a substrate 312 (e.g., a silicon, glass or ceramic substrate) defining a first opening 313 therein. A support structure 314 is disposed over the substrate 312 and defines a second opening 315 therethrough which may be axially aligned with the first opening 313 so as to define at least a portion of an acoustic path of the acoustic transducer 310. In various embodiments, the support structure 314 may be formed from glass (e.g., glass having a phosphorus content). In some embodiments, the second opening 315 may have the same cross-section (e.g., diameter) as the first opening 313. In other embodiments, the second opening 315 may have a larger or smaller cross-section relative to the first opening 313.

The acoustic transducer 310 includes a bottom or first diaphragm 320 and a top or second diaphragm 330 spaced apart from the first diaphragm 320 such that a cavity 341 having a pressure lower than atmospheric pressure, for example, in a range of 1 mTorr to 10 Torr, or 1 mTorr to 1 Torr, is formed therebetween. A back plate 340 is located between the first diaphragm 320 and the second diaphragm 330 in the cavity 341. The back plate 340 is anchored on the first diaphragm 320 and the second diaphragm 330 is anchored on the back plate 340 at corresponding edge anchors 343 and 333, respectively. The edge anchors 343 and 333 are radially offset from each other. It should be appreciated that the components included in the acoustic transducer 310 may have circular cross-sections as best shown in FIG. 3B. At least a portion of the first diaphragm 320, for example, proximate to a first perimetral edge 321 of the first diaphragm 320 and radially inwards thereof, is disposed on the support structure 314. The first perimetral edge 321 of the first diaphragm 320 extends beyond a perimeter of the support structure 314 and is coupled to the substrate 312. Furthermore, a second perimetral edge 331 of the second diaphragm 330 extends towards the first perimetral edge 321 and is coupled thereto. As shown is FIG. 3A, a portion 314*a* of the support structure 314 may be embedded in a volume between the edge anchors 333 and 343 and the second perimetral edge 331 of the second diaphragm 330.

Surfaces of each of the first diaphragm 320 and the second diaphragm 330 located outside the cavity 341 are exposed to atmosphere, for example, atmospheric air. A plurality of apertures 342 are defined in the back plate 340 such that a portion of the cavity 341 located between the first diaphragm 320 and the back plate 340 is connected to a second portion of the cavity 341 between the second diaphragm 330 and the back plate 340. While shown as including a single layer, in various embodiments, the second diaphragm 330 may also include a plurality of layers. For example, the second diaphragm 330 may include a first insulative layer (e.g., a silicon nitride layer), and a second conductive layer (e.g., a polysilicon layer).

To increase compliance, a first corrugation 322 and a second corrugation 332 are formed on the first diaphragm 320 and the second diaphragm 330, respectively. The first and second corrugations 322 and 332 protrude outwardly from the diaphragms 320 and 330, respectively in a direction away from the back plate 340, as previously described with respect to the acoustic transducer 110, and are circumferentially positioned about a longitudinal axis $A_L$ of the acoustic transducer, as shown in FIG. 3B. More than one corrugation may be defined in the first and second diaphragms 320, 330. In some implementations, the first and second corrugation 322 and 332 may be more proximate to outer edges of the first and second diaphragms 320 and 330 then a center point thereof. In other embodiments, the first and/or second corrugation 322 and 332 may be located more proximate to the longitudinal axis $A_L$ than the outer edge of the first and second diaphragm 320 and 330 or equidistant therefrom. Furthermore, the first and second corrugation 322 and 332 may be axially aligned or may be axially offset from each other relative to a longitudinal axis $A_L$ of the acoustic transducer 310. In various embodiments, the corrugations 322 and 332 may have a height in a range of 0.5 microns to 5 microns (e.g., 0.5, 1, 2, 3, 4 or 5 microns inclusive of all ranges and values therebetween), and a spacing measured between flat areas of the diaphragms 320, 330 is in a range of 1-15 microns (e.g., 1, 3, 5, 7, 9, 12, 14 or 15 microns inclusive of all ranges and values therebetween).

In order to prevent collapse of the first and second diaphragms 320 and 330 due to the large pressure differential between atmospheric air and the low pressure in the cavity 341, the second diaphragm 330 includes a plurality of posts 334 extending therefrom towards the first diaphragm 320 through corresponding apertures 342 of the back plate 340. Tips 335 of the posts 334 are positioned proximate to the first diaphragm 320 and spaced apart therefrom such that the post 334 is unanchored. When one or both of the diaphragms 320 and 330 vibrate or are otherwise displaced (e.g., bent) towards each other, the one or more of the tips 335 of the posts 334 contact an inner surface of the first diaphragm 320 located within the cavity 341 so as to restrict further displacement of the diaphragms 320, 330 towards each other, at least, at locations where the post 334 is positioned, thereby preventing collapse of the diaphragms 320, 330, as previously described herein. In various embodiments, the acoustic transducer 310 may have an average compliance in a region of the diaphragms 320 and 330 which can be more than 8 times an average compliance of a similar acoustic transducer that does not include outward facing corrugations and the unanchored posts. In some embodiments, a tip of each of the posts 334 may be coupled to the first diaphragm 320. The acoustic transducer 310 may include any number of posts 334, for example, in the range of 20 to 500 posts (e.g., 20, 25, 30, 35, 40, 45, 50, 100, 200, 300, 400 or 500 posts, inclusive). Furthermore, while FIG. 3A shows the posts 334 extending from the second diaphragm 330 towards the first diaphragm 320, in other embodiments, posts may additionally, or alternatively extend from the first diaphragm 320 towards the second diaphragm 330.

In some embodiments, an anchored post 336 extends from the first diaphragm 320 towards the second diaphragm 330 through a corresponding aperture 342 of the back plate. The anchored post 336 may extend from an inner rim of the first diaphragm 320 towards the second diaphragm 330. An apex 337 of the anchored post 336 contacts the first diaphragm 320 and is coupled thereto, such that the anchored post 336 is shaped as an inverted truncated cone. In other embodiments, the anchored post may have any other suitable shape, for example, a circular, square or rectangular cross-section, rounded S shaped sidewalls or any other suitable shape. A pierce 324 is defined in the first diaphragm 320, and a throughhole 338 is defined through the apex 337. The throughhole 338 at least partially overlaps the pierce 324 (e.g., is axially aligned with the pierce 324) and has the same cross-section (e.g., diameter) as the pierce 324. In other embodiments, the throughhole 338 may have a cross-section which is substantially larger than the cross-section (e.g., diameter) of the pierce 324. The pierce 324 and the throughhole 338 allow pressure equalization between a front volume and back volume of the acoustic transducer 310.

Figure 3C:
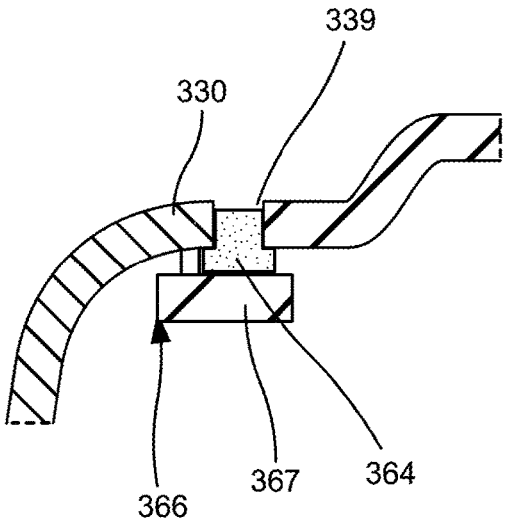
FIG. 3C shows a portion of the acoustic transducer of FIG. 3A indicated by the arrow A in FIG. 3A showing an opening defined in a second diaphragm of the acoustic transducer and a catch structure positioned below the opening.

A plurality of openings 339 may also be formed in the second diaphragm 330. Also referring now to FIG. 3C, the plurality of openings 339 are structured to allow an isotropic etchant (e.g., a wet etchant such as buffered hydrofluoric acid) to flow therethrough to etch and remove portions of the support structure 314 which may be disposed between the first and second diaphragms 320 and 330 during the fabrication process, so as to form the cavity 341. The apertures 342 defined in the back plate 340 also allow the etchant to flow therethrough and etch portions of the support structure 314 that may be positioned between the back plate 340 and the first diaphragm 320. The plurality of openings 339 may be sealed, for example, with a low stress silicon nitride (LSN). FIG. 3C shows a portion of the acoustic transducer 310 indicated by arrow A in FIG. 3A showing one opening 339 of the plurality of openings 339 defined in the second diaphragm 330 after being sealed with a plug 364 of a sealing material. A catch structure 366 is disposed beneath the opening 339 within the cavity 341 and coupled to the second diaphragm 330. The catch structure 366 includes a ledge 367 extending beneath the corresponding opening 339. The opening 399 may have a diameter which is sufficiently large to allow the sealing material to pass therethrough and deposit on the ledge 367. The sealing material builds up on the ledge 367 and eventually forms the plug 364 which seals the opening 339. In some embodiments the distance between the edge of the opening 339 and the edge of the ledge 367 may be in the range 1-10 um and may be non-uniform across the device. By altering the distance between the edge of the opening 339 and the edge of the ledge 367 the etch rate of the structural material in the vicinity of the opening 339 may be tuned.

Figure 3D:
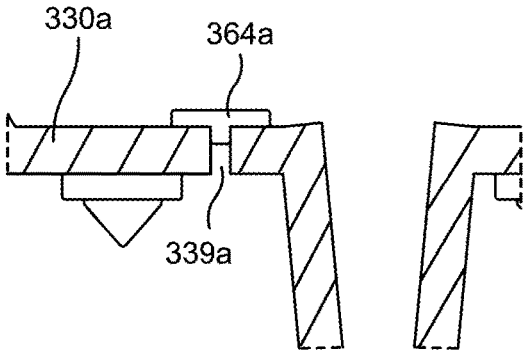
FIG. 3D shows a portion of a second diaphragm of an acoustic transducer showing a sealed opening defined in a second diaphragm of the acoustic transducer, according to another embodiment.

In some embodiments, the plurality of openings 339 defined in the second diaphragm 330 may be sealed without using the catch structure 366. For example, FIG. 3D is a side cross-section view of a portion of an acoustic transducer, according to still another embodiment. The portion shows a second diaphragm 330*a* of the acoustic transducer, showing an opening 339*a* defined in the second diaphragm 330*a*. The second diaphragm 330*a* is substantially similar to the second diaphragm 330, except that the openings 339*a* defined there are smaller in size than similar openings 339 defined in the second diaphragm 330. The openings 339*a* may be sufficiently small so as to allow the sealing material to form a plug 364*a* in an around the opening 339*a* without using a catch structure therebeneath, as described with the acoustic transducer 310. In some embodiments, diameter or cross-section of the holes may be in a range of 50-500 nm.

Figure 3E:
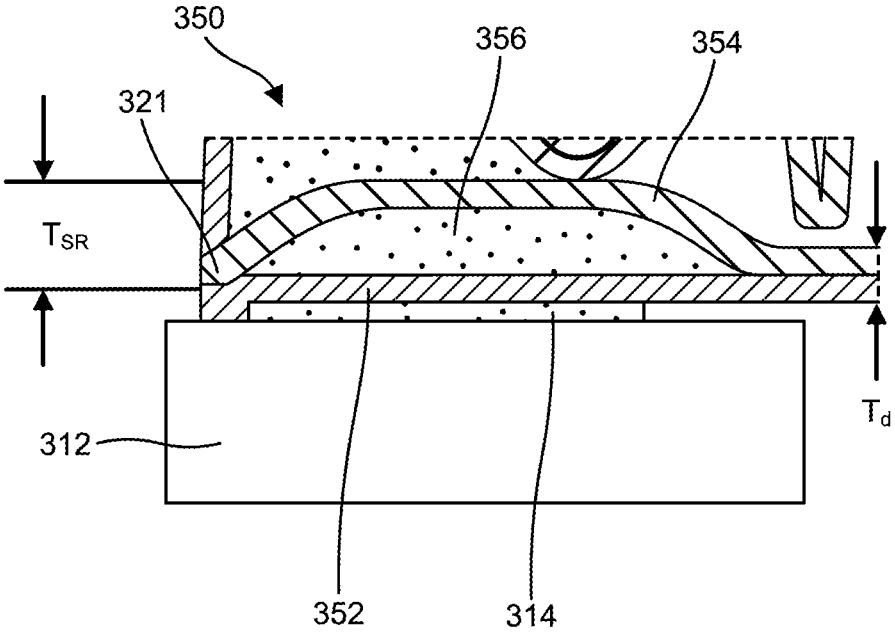
FIG. 3E shows a portion of the acoustic transducer of FIG. 3A indicated by the arrow B in FIG. 3A showing a stress relieving structure, according to an embodiment.

FIG. 3E shows a portion of the acoustic transducer 310 indicated by the arrow B in FIG. 3A to show a stress relieving structure 350 formed adjacent to the perimetral edge 321 or periphery of the first diaphragm 320. The stress relieving structure 350 can extend along the entire periphery of the first diaphragm 320 (e.g., circumferentially about the longitudinal axis $A_L$). In some other instances, the stress relieving structure 350 may extend only over a portion of the periphery of the first diaphragm 320.

The stress relieving structure 350 can have a thickness $T_{SR}$ that is greater than a thickness $T_d$ of the first diaphragm 320 proximate a center of the first diaphragm 320. In some embodiments, the thickness of the stress relieving structure 350 can gradually increase from the thickness $T_d$ of the diaphragm 320 to the thickness $T_{SR}$. For example, as shown in FIG. 3B, the thickness of the stress relieving structure 350 increases with increase in the distance from the center of the first diaphragm 320 until the thickness is equal to the thickness $T_{SR}$. That is, the thickness of the stress relieving structure 350 increases as a function of the distance from the center of the first diaphragm 320.

In some embodiments, the stress relieving structure 350 includes a layer of a first type of material disposed between two layers of a second type of material. For example, as shown in FIG. 3E, the stress relieving structure 350 includes a layer 356 of the first type of material embedded between a first diaphragm layer 352 and a second diaphragm layer 354 disposed over the first diaphragm layer, each formed from the second type of material. The diaphragm layers 352 and 354 can at least partially enclose the layer 356 of the first material. The first material can include one or more of silicon, silicon nitride, silicon oxynitride, glass having a phosphorus content, PSG and BPSG, or any other material used to form the support structure 314. The second type of material may include, silicon nitride (e.g., low stress silicon nitride). In other embodiments, the stress relieving structure is formed entirely from silicon nitride. That is, the stress relieving structure 350 can be a thicker portion of the first diaphragm 320.

The stress relieving structure 350 can reduce the risk of rise in stress along the periphery of the first diaphragm 320. In particular, large pressure transients incident on the first diaphragm 320 can cause an increase in the mechanical stress along the periphery of the first diaphragm 320. This increase in stress can increase the risk of fracture or deformity of the first diaphragm 320. The stress relieving structure 350 reduces the risk of rise in stress, and therefore increases a robustness of the first diaphragm 320.

Figure 3F:
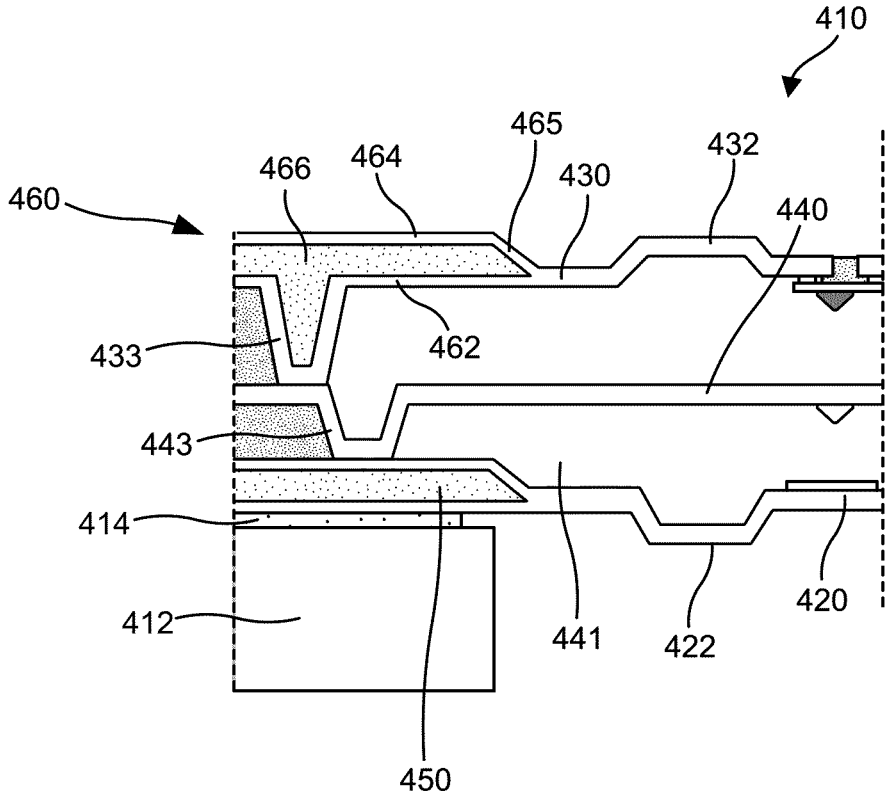
FIG. 3F shows a portion of an acoustic transducer that includes a first and second diaphragm, each of which include a stress relieving structure, according to another embodiment.

While described with respect to the first diaphragm 320, in various embodiments, the second diaphragm 330 may also include a stress relieving structure at a peripheral edge thereof. For example, FIG. 3F is a schematic illustration of an acoustic transducer 410, according to another embodiment. The acoustic transducer 410 includes a substrate 412 and a support structure 414. Diaphragms 420 and 430 disposed on the substrate 412 with a cavity 441 having a pressure lower than atmospheric pressure formed therebetween. A back plate 440 is disposed between the diaphragms 420 and 430 within the cavity 441. Each of the diaphragms 420 and 430 include outward projecting corrugations 422 and 432, as previously described herein. The back plate 440 is anchored on the first diaphragm 420 and the second diaphragm 430 is anchored on the back plate 440 at corresponding edge anchors 443 and 433, respectively. Similar to the acoustic transducer 410, the first diaphragm 420 includes a first stress relieving structure 450 at radial edge thereof which gradually increase in thickness towards the edge in a tapered fashion. The first stress relieving structure 450 is substantially similar to the stress relieving structure 350 previously described herein with respect to FIGS. 3A and 3E. Furthermore, the second diaphragm 430 also includes a second stress relieving structure 460 formed at a radial edge thereof. The second stress relieving structure 460 comprises a layer 466 of a first type of material (e.g., PSG or BPSG) embedded between first and second diaphragm layers 462 and 464 formed from a second type of material (e.g., a silicon nitride or low stress nitride). A portion of the first diaphragm layer 462 forms the edge anchor and a portion of the second diaphragm layer 464 is disposed over the edge anchor 433 such that the edge anchor 433 is also embedded with the first type of material. Expanding further, the first and second diaphragm layers 462 and 464 are disposed on each other to form the second diaphragm 430. Towards the edges of the second diaphragm 430, the second diaphragm layer 464 is spaced apart from the first diaphragm layer 462 to form the stress relieving structure 460. A tapered sidewall 465 couples the second diaphragm layer 464 to the first diaphragm layer 462.

Figure 3H:
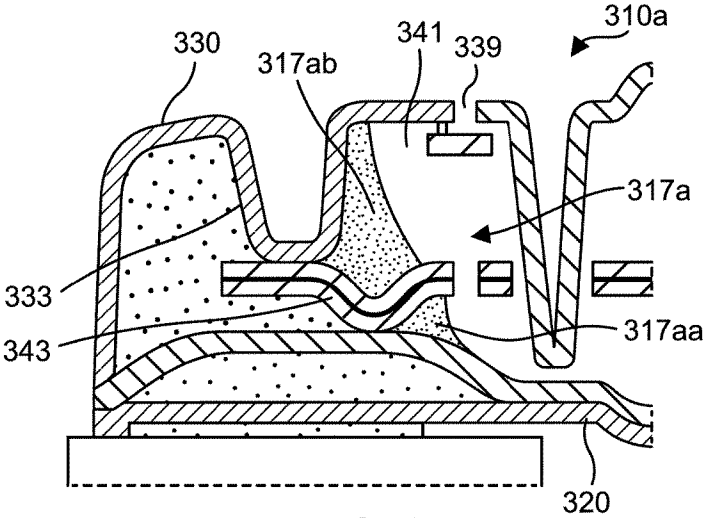
FIGS. 3H-J shows portions of various acoustic transducers that include a peripheral support structure, according to various embodiments.
Figure 3J:
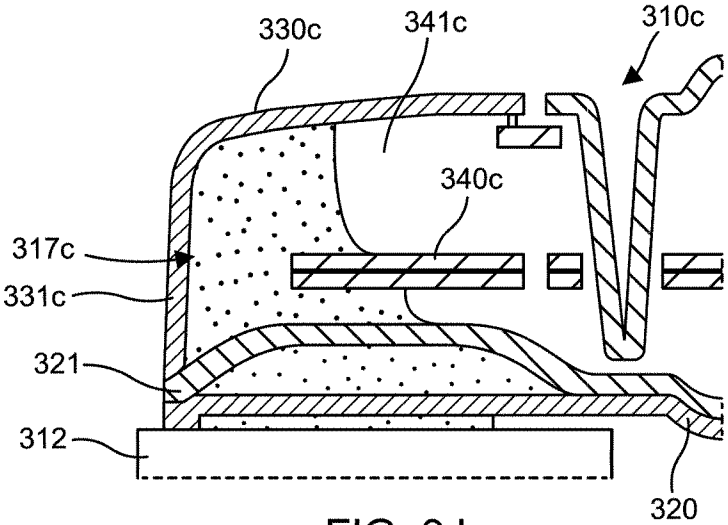
Figure 3G:
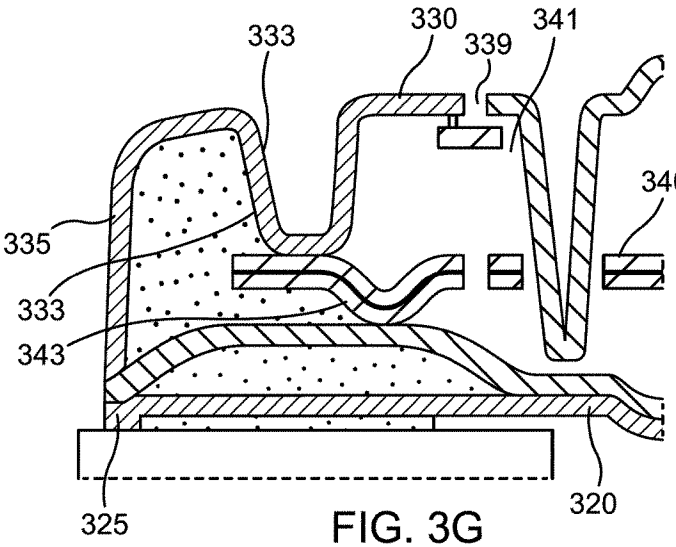
FIG. 3G shows a portion of a second diaphragm of the acoustic transducer of FIG. 3A indicated by the arrow C in FIG. 3A.

FIG. 3G shows a portion of the acoustic transducer of FIG. 3A indicated by the arrow C in FIG. 3A. Forming of the cavity 341 may involve etching a structural material (e.g., PSG or BPSG which may be part of the support structural layer from which the support structure 314 is formed) disposed between the first and second diaphragms 320 and 330 radially inwards of the edge anchors 333 and 343. In some embodiments, an isotropic etchant (e.g., a wet etchant) may be used or the etch may be timed so as to etch substantially all of the structural material between the diaphragms 320 and 330 such that the cavity 341 is substantially devoid of any structural material. The etchant enters the cavity 341 via the openings 339 which is later sealed, as previously described herein.

In other embodiments, the etch may be timed such that a perimetral support structure is formed in the cavity 341. For example, FIG. 3H is a side cross-section of a portion of an acoustic transducer 310*a*, according to another embodiment. The acoustic transducer 310*a* is substantially similar to the acoustic transducer 310. However, different from the acoustic transducer 310, a peripheral support structure 317 is formed at radial edges of the first and second diaphragms 320 and 330. The peripheral support structure 317*a* is attached to and supports at least a portion of a periphery of the first diaphragm 320 and the second diaphragm 330 and is located proximate to an edge of the first and second diaphragms 320 and 330 within the cavity 341. The peripheral support structure 317*a* includes a first layer 317*aa* (e.g., a first glass portion such as PSG having a phosphorus content in range of 0.01 wt % to 10 wt %) and a second layer 317*ab* (e.g., a second glass portion having a phosphorus content in a range of 0.01 wt % to 10 wt %, such as PSG portion), each having the same impurity content (e.g., the same phosphorous content). For example, etching of the structural material used to form the support structure 314 may be performed for a predetermined time and may be stopped prior to reach the edge anchors 333 and 343 so as to form the peripheral support structure 317*a*.

In some embodiments, the portions of the structural material proximate to the openings 339 get etched first relative to the portions distal from the openings 339, such that a radially inner sidewall of the peripheral support structure 317*a* has a tapered profile. For example, as shown in FIG. 3H, the radially inner sidewall of the peripheral support structure 317*a* is tapered from the second diaphragm 330 to the back plate 340, and from the back plate 340 to the first diaphragm 320. In other embodiments, the first layer 317*aa* may have a first phosphorous content (e.g., in a range of 2-6%) and the second layer 317*ab* may have a second phosphorous content (e.g., in a range of 4-10%) different from the first phosphorous content. This may cause unequal etching of the structural material resulting in the tapered profile. The peripheral support structure 317*a* may increase robustness of the diaphragms 320 and 330.

Figure 3I:
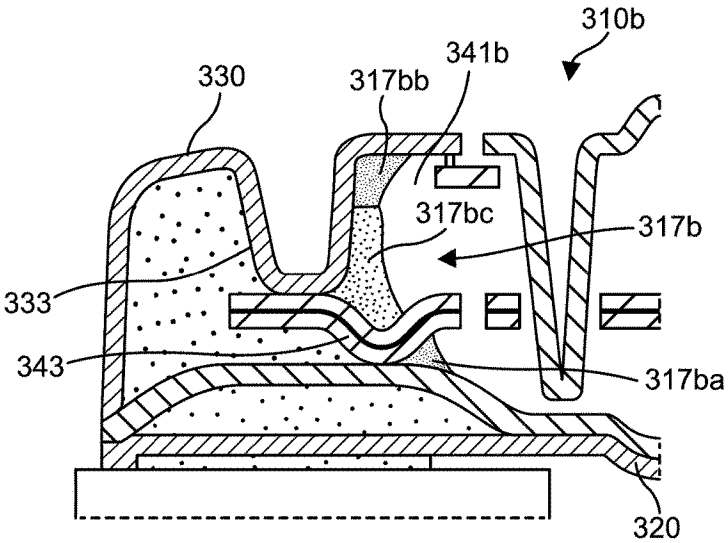

In some embodiments, a peripheral support structure may include 3 or more layers. For example, FIG. 3I is a schematic illustration of a portion of an acoustic transducer 310*b*, according to still another embodiment. The acoustic transducer 310*b* is substantially similar to the acoustic transducer 310*a*. Different from the acoustic transducer 310*a*, the acoustic transducer 310*b* includes a peripheral support structure 317*b* including a first layer 317*ba* (e.g., a first glass, PSG or BPSG portion) proximate to radial edges of the first diaphragm 320 and a second layer 317*bb* (e.g., a second glass, PSG or BPSG portion) proximate to radial edges of the second diaphragm 330, each having a low impurity content (e.g., glass having a phosphorus content in a range of 2-4%). The peripheral support structure 317*b* also includes a third layer 317*bc* (e.g., a third glass, PSG or BPSG portion) disposed between the first and second layers 317*ba* and 317*bb*. The third layer 317*bc* has a higher impurity content (e.g., glass having a phosphorus content in a range of 4-10%) relative to the first and second layers 317*ba* and 317*bb*. Etching of the structural material layers may be performed for a predetermined time to stop prior to reaching the edge anchors 333 and 343 so as to form the peripheral support structure 317*b*. The first and second layers 317*ba/bb* having the lower impurity content etch more slowly than the third layer 317*bc* such that an inner sidewall of each of the first and second layers 317*ba/bb* is tapered radially inwards from the third layer 317*bc* towards the diaphragms 320 and 330, respectively. This may further increase robustness of each of the first and second diaphragms 320 and 330. In some embodiments, an impurity content within one or more of the layers 317*ba/bb/bc* may also vary along a height thereof.

FIG. 3J is a side cross-section of a portion of an acoustic transducer 310*c*, according to still another embodiment. The acoustic transducer 310*c* includes the first diaphragm 320 disposed on the substrate 312. A second diaphragm 330*c* is spaced apart from the first diaphragm 320 such that a cavity 341*c* having a pressure lower than atmospheric pressure is formed therebetween. A back plate 340*c* is disposed between the first and second diaphragms 320 and 330*c* in the cavity 341*c*. Different from the second diaphragm 330 and the back plate 340, the second diaphragm 330*c* and the back plate 340*c* do not include edge anchors. Instead, a perimetral edge 331*c* of the second diaphragm 330*c* extends towards the perimetral edge 321 of the first diaphragm 320 and is coupled thereto. A peripheral support structure 317*c* is disposed in the cavity proximate the perimetral edge 331*c* of the second diaphragm 330*c* over the first diaphragm 320. The periphery of the back plate 340*c* is embedded in the peripheral support structure 317*c*. The peripheral support structure 317*c* may include a single layer having a single phosphorus content, a varying phosphorus content, or include plurality of layers, each layer having the same or different phosphorus content.

Figure 4:
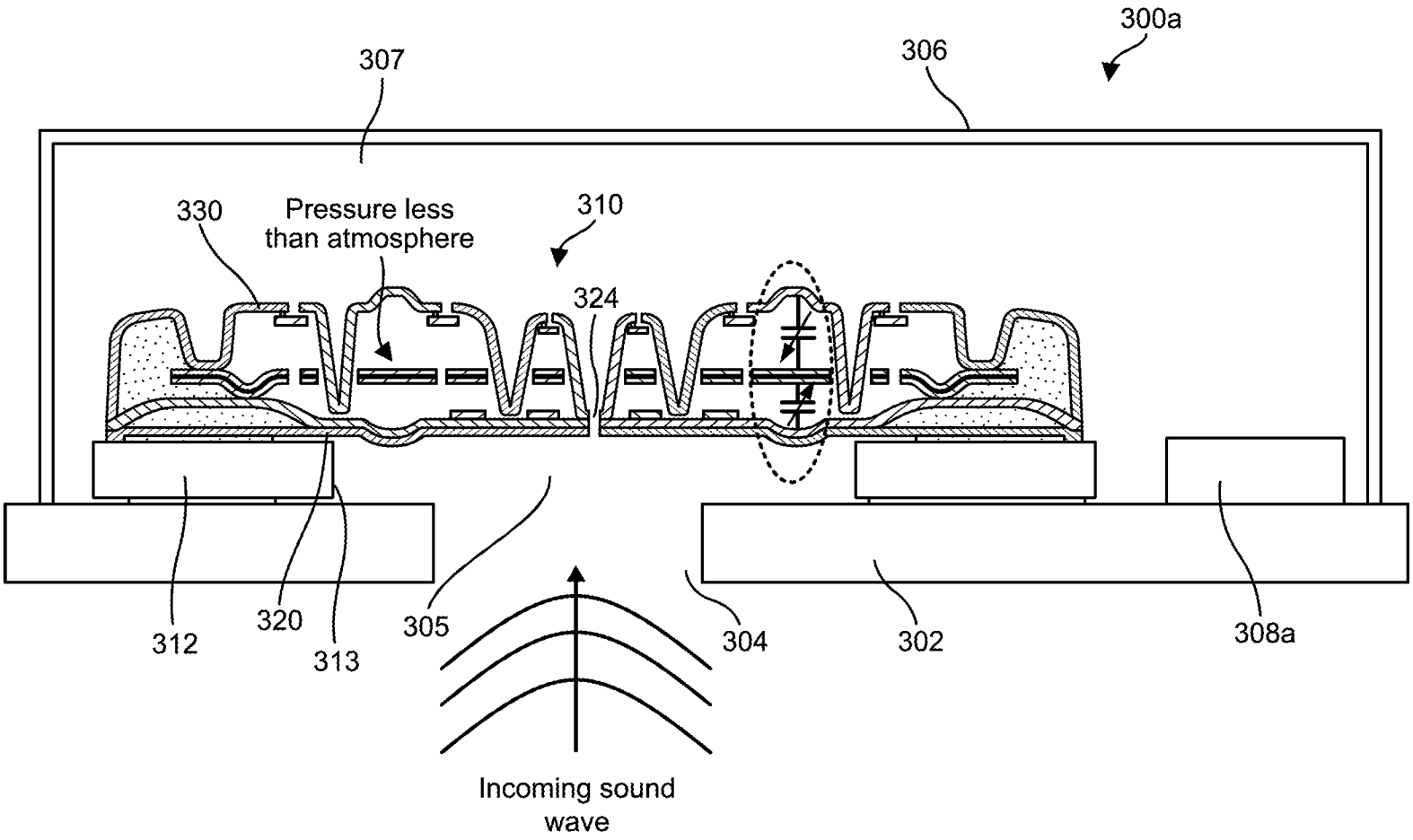
FIG. 4 is a schematic illustration of a microphone assembly that includes the acoustic transducer of FIG. 3, according to an embodiment.

In some embodiments, the acoustic transducer 310 may be included in a microphone assembly. For example, FIG. 4 is a schematic illustration of a microphone assembly 300*a*, according to an embodiment. The microphone assembly 300*a* may comprise a MEMS microphone assembly. The microphone assembly 300*a* may be used for converting acoustic signals into electrical signals in any device such as, for example, cell phones, laptops, television remotes, tablets, audio systems, head phones, wearables, portable speakers, car sound systems or any other device which uses a microphone assembly.

The microphone assembly 300*a* comprises a base 302 defining a port 304 or sound port therein such that the microphone assembly 300*a* is a bottom port microphone assembly. A lid 306 is positioned on the base 302 and defines an inner volume within which the acoustic transducer 310 and an integrated circuit 308*a* are positioned. In other embodiments, the port 304 may be defined in the lid 306 instead of the base 302 such that the microphone assembly 300 includes a top port microphone assembly. The lid 306 may be formed from a suitable material such as, for example, metals (e.g., aluminum, copper, stainless steel, etc.), plastics, polymers, etc., and may be coupled to the base 302, for example, via an adhesive, solder, or fusion bonded thereto. In some embodiments, the lid 306 could be a composite of metal and plastics, for example, metal having insert molded or over molded plastic.

The base 302 can be formed from materials used in printed circuit board (PCB) fabrication (e.g., plastics). For example, the substrate may include a PCB configured to mount the acoustic transducer 310, the integrated circuit 308*a* and the lid 306 thereon. The acoustic transducer 310 is positioned on the port 304 and configured to generate an electrical signal responsive to an acoustic signal. The acoustic transducer 310 separates a front volume 305 from a back volume 307 of the microphone assembly, the front volume 305 being in fluidic communication with the port 304. For example, substrate 312 may be positioned on the base 302 surrounding the port 304 such that the opening 313 thereof is axially aligned with the port 304. The bottom diaphragm 320 may be positioned facing the port 304 so as to receive acoustic signals through the port 304 via the front volume 305. The top diaphragm 330 faces the back volume 307. The pierce 324 in the diaphragm 320, allows barometric pressure equalization between the front volume 305 and the back volume 307.

In FIG. 4, the acoustic transducer 310 and the integrated circuit 308*a* are shown disposed on a surface of the base 302, but in other embodiments one or more of these components may be disposed on the lid 306 (e.g., on an inner surface of the lid 306), sidewalls of the lid 306 or stacked atop one another. In some embodiments, the base 302 may include an external-device interface having a plurality of contacts coupled to the integrated circuit 308, for example, to connection pads (e.g., bonding pads) which may be provided on the integrated circuit 308*a*. The integrated circuit 308*a* is an application specific integrated circuit (ASIC) in some implementations. The contacts may be embodied as pins, pads, bumps or balls among other known or future mounting structures. The functions and number of contacts on the external-device interface depend on the protocol or protocols implemented and may include power, ground, data, and clock contacts among others. The external-device interface permits integration of the microphone assembly 300 with a host device using reflow-soldering, fusion bonding, or other assembly processes.

The integrated circuit 308*a* is electrically coupled to the acoustic transducer 310, for example, via electrical leads and may also be coupled to the base 302 (e.g., to a trace or other electrical contact disposed on the base 302). The integrated circuit 308*a* receives an electrical signal from the acoustic transducer 310 and may amplify and condition the signal before outputting a digital or analog acoustic signal. The integrated circuit 308*a* may also include a protocol interface (not shown), depending on the output protocol desired. The microphone assembly 300*a* may also be configured to permit programming or interrogation thereof as described herein. Exemplary protocols include but are not limited to PDM, PCM, SoundWire, I2C, I2S and SPI, among others.

The microphone assembly 300*a* may include an external-device interface (i.e., an electrical interface) having a plurality of electrical contacts (e.g., power, ground data, clock) for electrical integration with a host device. The external device interface can be disposed on an outer surface of the base 302 and configured for reflow soldering to a host device. Alternatively the interface can be disposed on some other surface of the base 302 or lid 306. The integrated circuit 308*a* may be covered by an encapsulating material which may have electrical insulating, electromagnetic and thermal shielding properties. The integrated circuit 308*a* receives an electrical signal from the acoustic transducer 310 and may amplify or condition the signal before outputting a digital or analog acoustic signal. For example, the integrated circuit 308*a* may receive an electrical signal from the acoustic transducer 310 having a characteristic (e.g., voltage) that changes responsive to changes in capacitance in the acoustic transducer 310 (e.g., capacitance changes between the diaphragms 320, 330 and the back plate 340 of the acoustic transducer 310), or receive a piezoelectric current from the acoustic transducer 310 which is representative of the acoustic signal.

Figure 5:
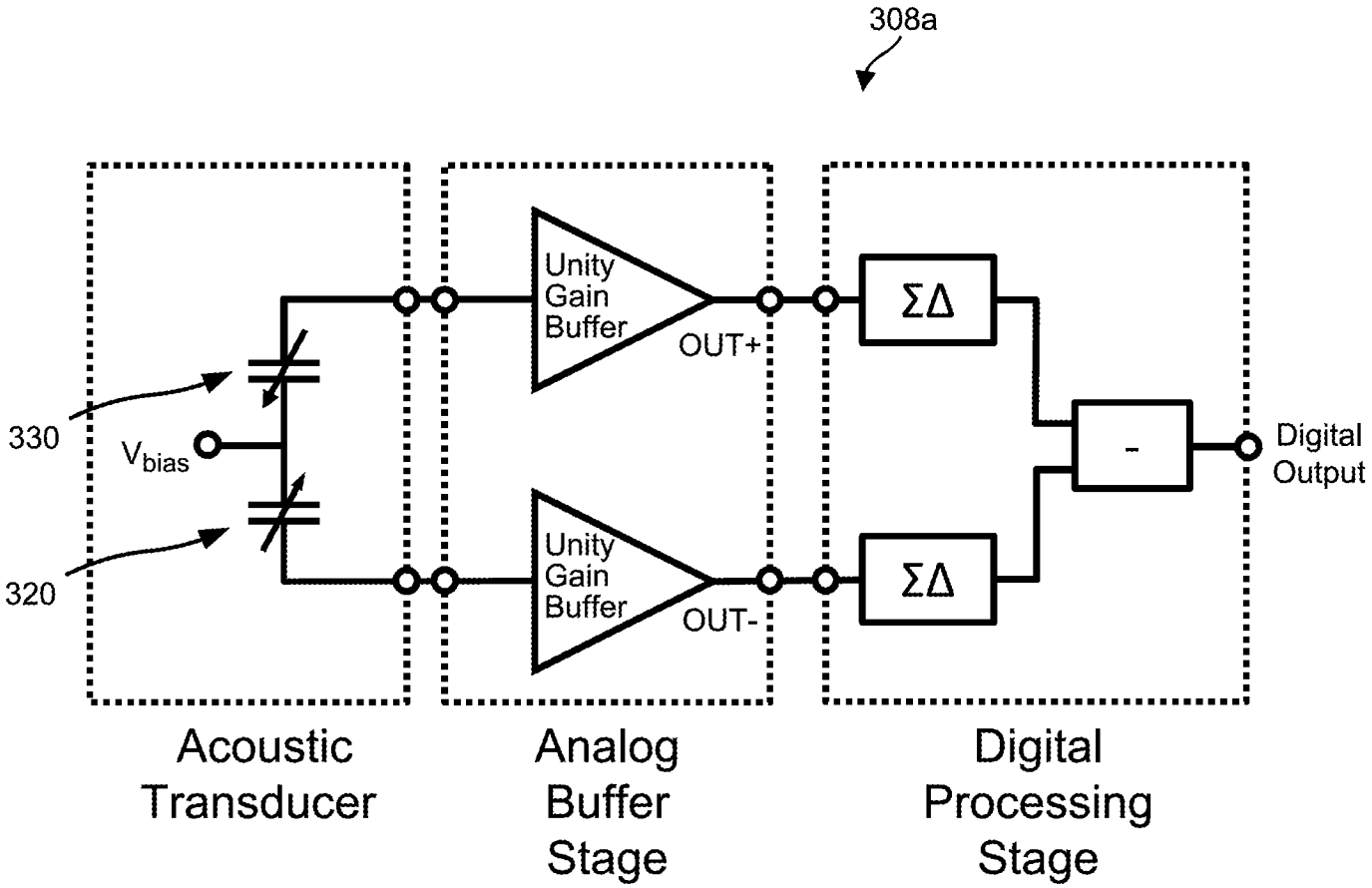
FIG. 5 is a simplified circuit diagram of the microphone assembly of FIG. 4, according to an embodiment.

FIG. 5 is a simplified circuit diagram of the microphone assembly 300*a*. The diaphragms 320 and 330 are biased at a bias voltage $V_{bias}$. In some embodiments, unequal bias may be applied to the capacitances formed by each diaphragm 320 and 330. The change in capacitance of the second diagram 330 is out of phase with change in capacitance of the first diaphragm 320 because of an acoustic signal only impinging on the first diaphragm 320 after entering the port 304. Mechanical coupling of the diaphragms 320 and 330 through the posts cause the diaphragms 320, 330 to vibrate in unison so that the diaphragms can be modeled as out of phase capacitors. The integrated circuit 308*a* may include an analog buffer stage to amplify the electrical signals received from the diaphragms 320 and 330. The integrated circuit 308*a* may also include an analog-to-digital conversion (ADC) circuitry, such as a sigma-delta modulator (ΣΔ in FIG. 5). However, the processing may be performed in the analog domain such that the ADC may be excluded. The resultant electrical signal received from the integrated circuit 308*a* is indicative of the acoustic signals detected by the acoustic transducer 310.

Figure 6:
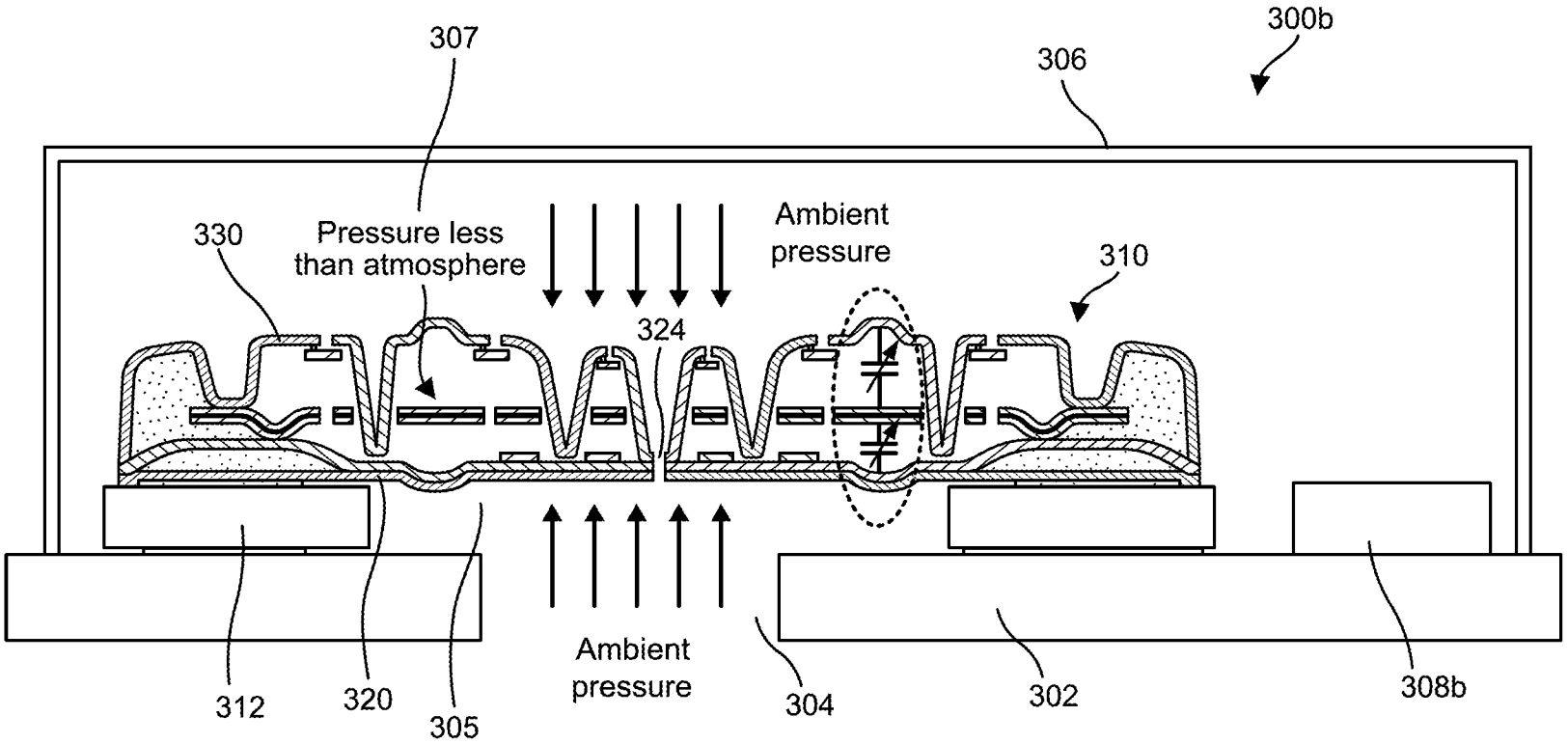
FIG. 6 is a schematic illustration of a pressure sensing assembly that includes the acoustic transducer of FIG. 3, according to an embodiment.

In some embodiments, the acoustic transducer 310 may be used in a pressure sensing assembly. For example, FIG. 6 shows a pressure sensing assembly 300*b* that includes the acoustic transducer 310 positioned on the base 302, and includes the lid 306 and an integrated circuit 308*b* (e.g., an ASIC). However, the front volume 305 and back volume 307 of the acoustic transducer 310 may both be open to atmospheric or ambient pressure (e.g., via pressure equalization through the piercing 324). This causes the ambient or atmospheric pressure to act equally on each of the first and second diaphragms 320 and 330 so that the diaphragms 320 and 330 experience a common mode or in-phase change in capacitance resulting from deflection or bending of the diaphragms 320, 330 in the regions between the posts.

Figure 7:
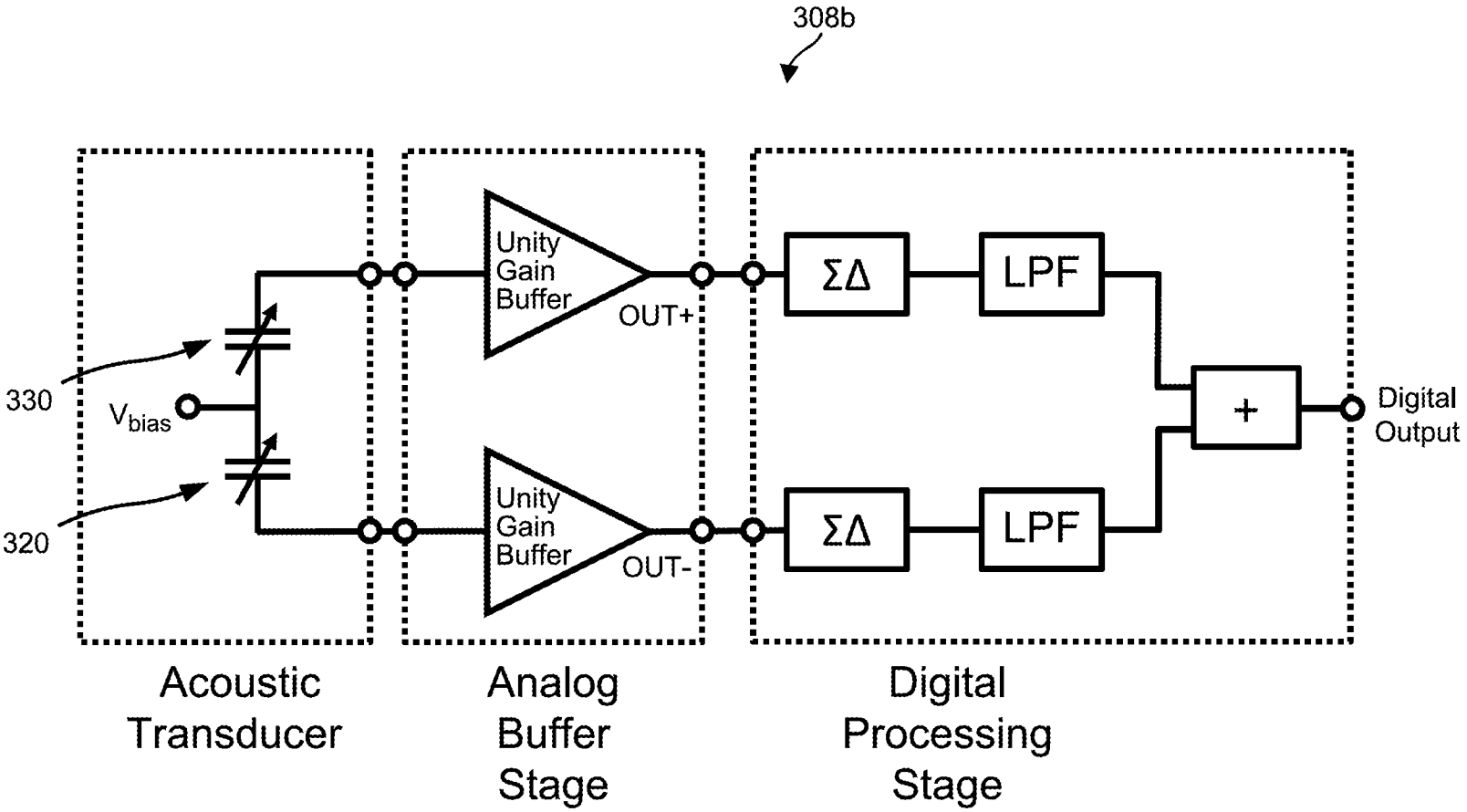
FIG. 7 is a simplified circuit diagram of the pressure sensing assembly of FIG. 8, according to an embodiment

FIG. 7 is a simplified circuit diagram of the pressure sensing assembly 300*b*. The diaphragms 320 and 330 are biased at a bias voltage $V_{bias}$. In some embodiments, unequal bias may be applied to the capacitances formed by each diaphragm. The change in capacitance of the second diagram 330 is in-phase with changes in atmospheric pressure acting equally on each of the diaphragms 320 and 330, so that the diaphragms can be modeled as in-phase capacitances. The integrated circuit 308*b* may include an analog buffer stage to amplify the electrical signals received from the diaphragms 320 and 330. The integrated circuit 308*b* may also include an analog-to-digital conversion (ADC) circuitry, such as a sigma-delta modulator (τΔ in FIG. 7). However, the processing may be performed in the analog domain such that the ADC may be excluded. The integrated circuit 308*b* may also include a low pass filter (LPF), for example, to reduce noise and/or to isolate the atmospheric pressure change from an acoustic signal. The resultant electrical signal received from the integrated circuit 308*b* is indicative of the atmospheric pressure detected by the acoustic transducer 310.

Figure 8:
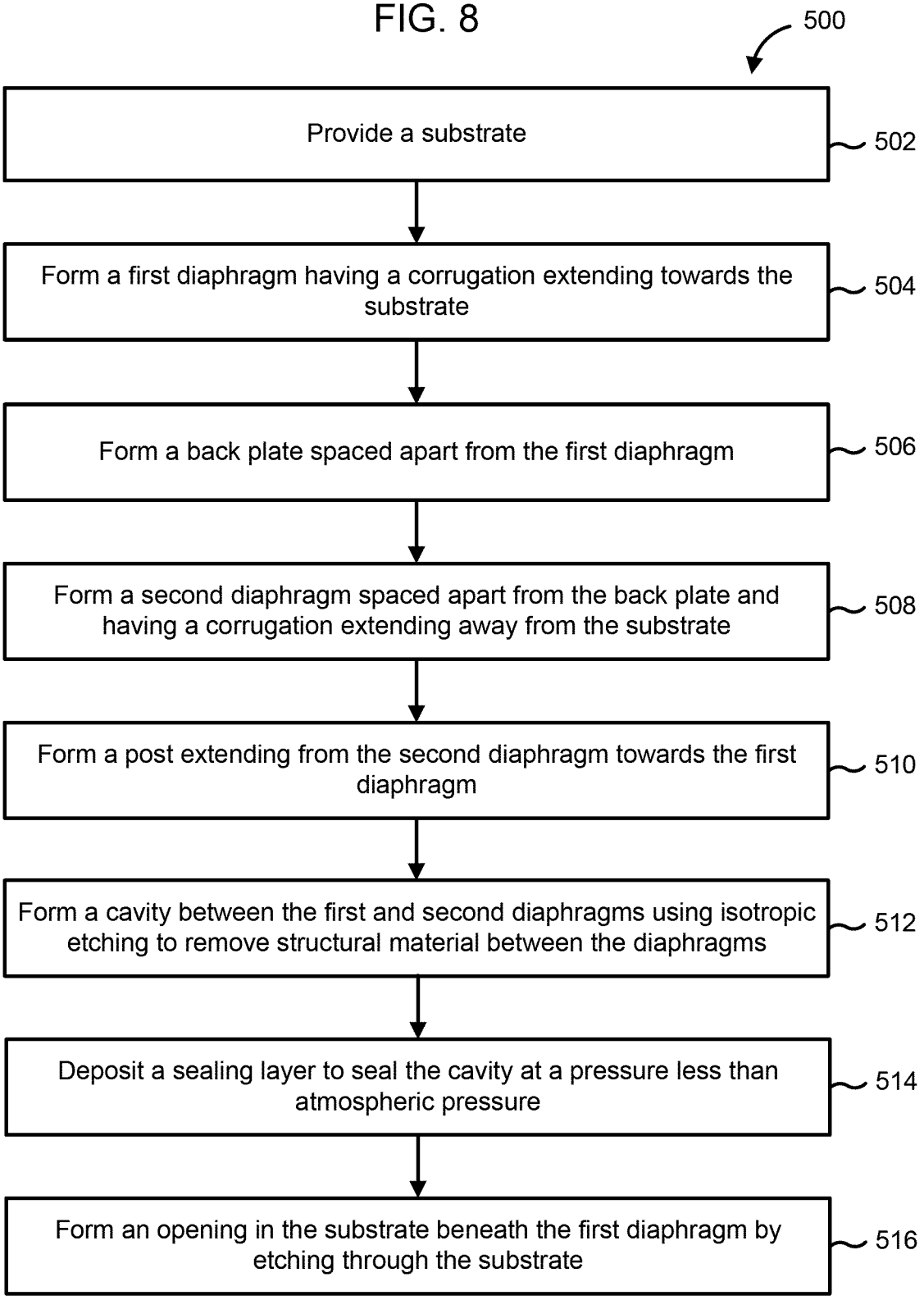
FIG. 8 is a schematic flow diagram of a method for forming a dual diaphragm acoustic transducer, according to an embodiment.

FIG. 8 is a schematic flow diagram of an example method 500 for fabricating an acoustic transducer (e.g., the acoustic transducer 110, 210*e*, 310, 310*a/b/c*, 410), according to an embodiment. The method comprises providing a substrate, at 502. The substrate may include, for example, the substrate 112, 212, 312, 412 and may be formed from silicon, silicon oxide, glass, ceramics, or any other suitable material.

At 504, a first diaphragm is formed over the substrate such that first diaphragm is attached at its periphery to the substrate. The first diaphragm (e.g., the first diaphragm 120, 220*e*, 320, 420) has outward facing corrugations extending towards the substrate. The first diaphragm may be formed from a low stress material, for example LSN, a low stress ceramic, or polysilicon.

At 506, a back plate (e.g., the back plate 140, 240, 240*e*, 340, 340*c*, 440) is formed spaced apart from the first diaphragm in a direction away from the substrate. The back plate material may be substantially inflexible relative to the first diaphragm and the second diaphragm material, and may include, for example, a poly/SiN/poly layer stack or other conductor/insulator/conductor layer stack. The back plate may also be formed from a single layer of conducting material such as polysilicon. In some embodiments, a plurality of apertures are also formed through the back plate.

At 508, a second diaphragm (e.g., the second diaphragm 130, 230*e*, 330, 330*a*, 330*c*, 430) is formed spaced apart from the back plate in a direction away from the substrate and attached at its periphery to the substrate. The second diaphragm may also be formed from a from a low stress material, for example, LSN, a low stress ceramic, or polysilicon. In some embodiments, forming the second diaphragm may also include forming a post (e.g., the post 234*a*, 234*b*, 234*c*, 234*d*, 334) extending from the second diaphragm towards the first diaphragm, at 510. A portion of the post is positioned proximate to the other diaphragm (e.g., spaced apart from the other diaphragm by a distance of 50 nm to 2 microns in a default position, as previously described herein) and configured to contact the other diaphragm in response to movement of at least one of first diaphragm and the second diaphragm towards the other diaphragm so as to prevent collapse of the first diaphragm and the second diaphragm under atmospheric pressure.

In some embodiments, forming the second diaphragm may also include forming an anchored post (e.g., the anchored post 336) extending from the first diaphragm towards the second diaphragm through a corresponding aperture in the back plate, an apex of the anchored post contacting the other diaphragm and coupled thereto. A throughhole may be defined through the apex, and a pierce at least partially overlapping the throughhole may be defined in the second diaphragm so as to allow pressure equalization between a front volume and back volume of the acoustic transducer. In various embodiments, the throughhole and the pierce may be formed through a deep reactive ion etching (DRIE) process.

At 512, a cavity is formed between the first and second diaphragms by using isotropic etching to remove structural material from between the first diaphragm and the second diaphragm. In some embodiments, the back plate defines at least one aperture therethrough such that a first portion of the cavity located between the first diaphragm and the back plate is connected to a portion of the cavity between the second diaphragm and the back plate. In some embodiments, openings are defined in the second diaphragm, For example, the openings 339, 339*a* may be defined in the second diaphragm 330, 330*a* via a wet etch or dry etch process. The openings allow an isotropic etchant to contact and etch a structural material (e.g., a portion of a support structure) disposed between the first and second diaphragms so as to form the cavity.

In some embodiments, the structural material may be etched (e.g., glass such as PSG having a phosphorus content in a range of 0.01 wt % to 10 wt %) such that a portion of the support structure remains attached to and supporting at least a portion of a periphery of the first diaphragm and the second diaphragm over the substrate. The peripheral support structure is located proximate to an edge of the first and second diaphragms within the cavity.

At 514, a sealing layer (e.g., low-stress silicon nitride, metal etc.) is deposited using a low pressure deposition process (e.g. LPCVD, PECVD, ALD, sputter, or evaporation) to seal the openings (e.g., the openings 339, 339*a*) with a plug (e.g., the plug 364, 364*a*). This operation seals the cavity at a pressure less than atmospheric pressure (e.g., in a range of 1 mTorr to 10 Torr, or 1 mTorr to 1 Torr).

At 516, an opening (e.g., the opening 313) is formed in the substrate (e.g., the substrate 312) by etching through the substrate using, for example, a deep reactive ion etch (DRIE) process. In some embodiments, an additional etch (e.g. wet etch using buffered hydrofluoric acid) may occur to define the location of support structure 314, 414. In some embodiments, the opening in the substrate may be formed before forming a cavity between the first and second diaphragms and before sealing the cavity at a pressure less than atmospheric (e.g. operation 516 may occur before operation 514, or before operation 512).

Figure 9:
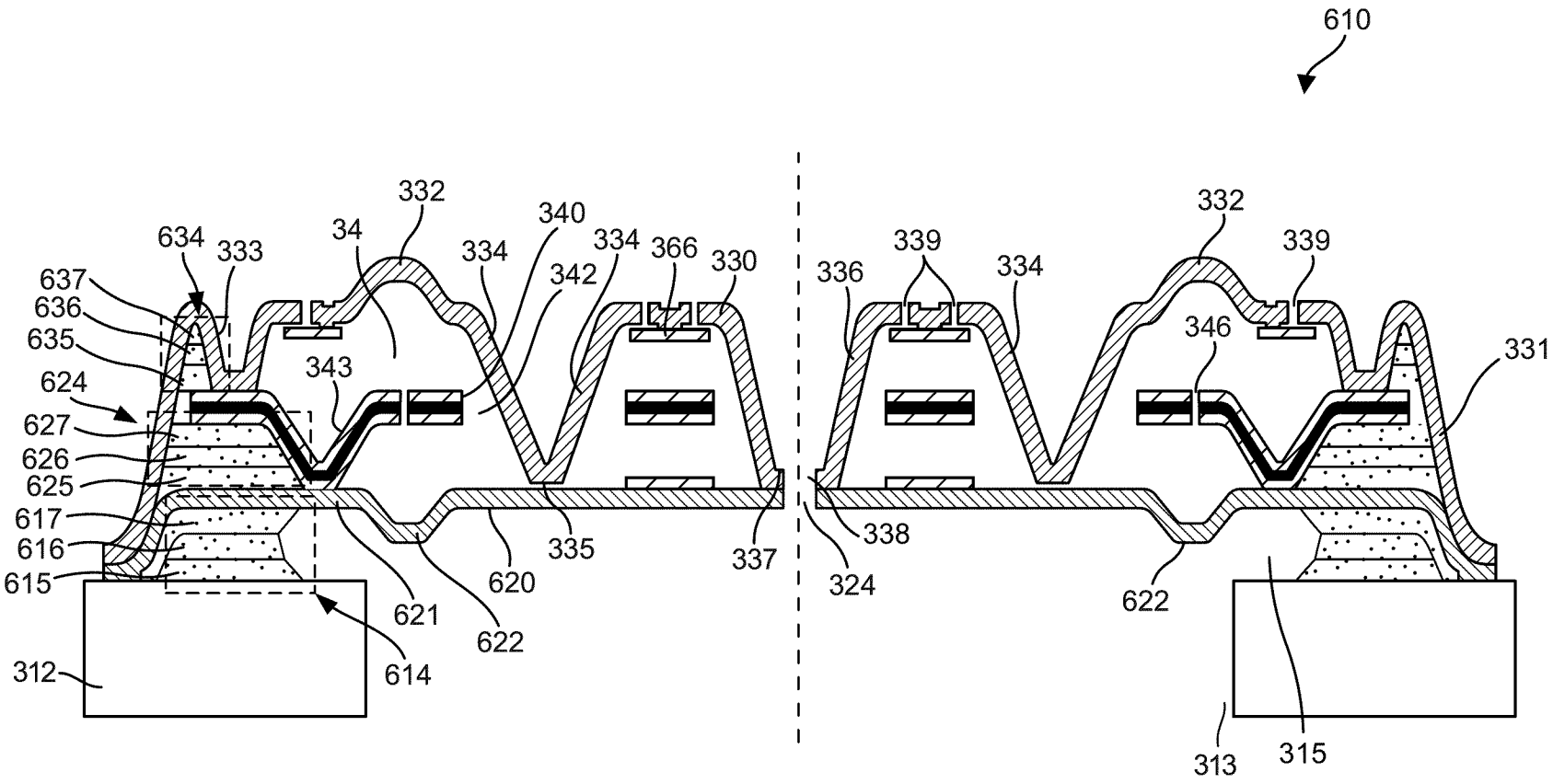
FIG. 9 is a side cross-section view of an acoustic transducer, according to another embodiment.

FIG. 9 is a side cross-section view of an acoustic transducer 610, according to still another embodiment. The acoustic transducer 610 may include, for example, a MEMS acoustic transducer for use in a MEMS microphone assembly or a MEMS pressure sensor. The acoustic transducer 610 is configured to generate electrical signals in response to acoustic signals or atmospheric pressure changes. The acoustic transducer 610 is similar to the acoustic transducer 310 with some differences described herein.

The acoustic transducer 610 includes the substrate 312 (e.g., a silicon, glass or ceramic substrate) defining the first opening 313 therein. However, different from the acoustic transducer 310, a support structure 614 is disposed over the substrate 312 and defines the second opening 315 therethrough which may be axially aligned with the first opening 313 so as to define at least a portion of an acoustic path of the acoustic transducer 310. The support structure 614 includes a support structure first layer 615, a support structure second layer 616, and a support structure third layer 617. In some embodiments, the support structure first layer 615 includes silicon oxide (e.g., thermal silicon oxide) having a thickness in a range of 300 nm to 900 nm (e.g., 300, 400, 500, 600, 700, 800, or 900 nm, inclusive). In some embodiments, the support structure second layer 616 includes glass having a phosphorous content in a range of 6 wt % to 8 wt % (e.g., 6, 7, or 8 wt %, inclusive). For example, the glass may include phosphosilicate glass. In some embodiments, the support structure third layer 617 includes silicon oxide {e.g., deposited by low pressure chemical vapor deposition (LPCVD) process} and having a thickness in a range of 400 nm to 700 nm (e.g., 400, 450, 500, 550, 600, 650 or 700 nm, inclusive).

The acoustic transducer 610 includes a bottom or first diaphragm 620 and the top or second diaphragm 330 spaced apart from the first diaphragm 620 such that a cavity 341 having a pressure lower than atmospheric pressure, for example, in a range of 1 mTorr to 10 Torr, or 1 mTorr to 1 Torr, is formed therebetween. Different from the first diaphragm 320, the first diaphragm 620 does not include a stress relieving structure.

The back plate 340 is located between the first diaphragm 620 and the second diaphragm 630 in the cavity 341. At least portion of the first diaphragm 620, for example, proximate to a first perimetral edge 621 of the first diaphragm 620 and radially inwards thereof, is disposed on the support structure 614. The first perimetral edge 621 of the first diaphragm 620 extends beyond a perimeter of the support structure 614 and is coupled to the substrate 312. Furthermore, a second perimetral edge 331 of the second diaphragm 330 extends towards the first perimetral edge 621 and is coupled thereto.

Surfaces of each of the first diaphragm 620 and the second diaphragm 330 located outside the cavity 341 are exposed to atmosphere, for example, atmospheric air. A plurality of apertures 342 are defined in the back plate 340 such that a portion of the cavity 341 located between the first diaphragm 620 and the back plate 340 is connected to a second portion of the cavity 341 between the second diaphragm 330 and the back plate 340. Each of the first diaphragm 620 and the second diaphragm 330 includes outwardly protruding corrugations 622 and 332, respectively, as previously described herein. In various embodiments, the corrugations 622 and 332 may have a height in a range of 0.5 microns to 5 microns (e.g., 0.5, 1, 2, 3, 4 or 5 microns inclusive of all ranges and values therebetween), and a spacing measured between flat areas of the diaphragms 620, 330 is in a range of 1-15 microns (e.g., 1, 3, 5, 7, 9, 12, 14 or 15 microns inclusive of all ranges and values therebetween). It should be appreciated that the corrugations 322, 622 are circumferential and may include a plurality of corrugations.

The second diaphragm 330 includes a plurality of posts 334 extending therefrom towards the first diaphragm 620 through corresponding apertures 342 of the back plate 340. In other embodiments, the posts 334 may extends from the first diaphragm 620 towards the second diaphragm 330. The anchored post 336 extends from the first diaphragm 620 towards the second diaphragm 330 through a corresponding aperture 342 of the back plate. A pierce 324 is defined in the first diaphragm 620, and a throughhole 338 is defined through the apex 337. The throughhole 338 at least partially overlaps the pierce 324 (e.g., is axially aligned with the pierce 324) and may have the same or different cross-section (e.g., diameter) as the pierce 324.

A plurality of openings 339 may also be formed in the second diaphragm 330 to allow an isotropic etchant (e.g., a wet etchant such as buffered hydrofluoric acid) to flow therethrough to etch and remove portions of the support structure 314, as previously described herein. The plurality of openings 339 may be sealed, for example, with a low stress silicon nitride (LSN). A catch structure 366 is disposed beneath the opening 339 within the cavity 341 and coupled to the second diaphragm 330, as previously described herein. In some embodiments, the catch structures 366 can be formed from a conducting material (e.g. polysilicon). The layer used to form the catch structures 366 can serve dual purpose as the top diaphragm electrode. In some embodiments, the plurality of openings 339 defined in the second diaphragm 330 may be sealed without using the catch structure 366.

As shown in FIG. 9 a second support structure 624, and a third support structure 634 is embedded in a volume between the edge anchors 333 and 343 and the second perimetral edge 331 of the second diaphragm 330. The second support structure 624 is disposed between the first diaphragm 620 and the back plate 340, and includes a second support structure first layer 625, a second support structure second layer 626, and a second support structure third layer 627. In some embodiments, the second support structure first layer 625 includes silicon oxide (e.g., LPCVD silicon oxide) having a thickness in a range of 400 nm to 700 nm (e.g., 400, 450, 500, 550, 600, 650 or 700 nm, inclusive). In some embodiments, the second support structure second layer 626 includes glass having a phosphorous content in a range of 6 wt % to 8 wt % (e.g., 6, 7, or 8 wt %, inclusive) and having a thickness in a range of 1,000 nm to 2,000 nm (e.g., 1,000, 1,100, 1,200, 1,300, 1,400, 1,500, 1,600, 1,700, 1,800, 1,900, or 2,000 nm, inclusive). In some embodiments, the second support structure third layer 627 also includes glass having a phosphorous content in a range of 3 wt % to 6 wt % (e.g., 3, 3.5, 4, 4.5, 5, 5.5, or 6 wt %, inclusive) and having a thickness in a range of 1,000 nm to 2,000 nm (e.g., 1,000, 1,100, 1,200, 1,300, 1,400, 1,500, 1,600, 1,700, 1,800, 1,900, or 2,000 nm, inclusive).

The third support structure 634 is disposed between the second diaphragm 330 and the back plate 340, and includes a third support structure first layer 635, a third support structure second layer 636, and a third support structure third layer 637. In some embodiments, the third support structure first layer 635 includes glass having a phosphorous content in a range of 3 wt % to 6 wt % (e.g., 3, 3.5, 4, 4.5, 5, 5.5, or 6 wt %, inclusive) and having a thickness in a range of 500 nm to 1,000 nm (e.g., 500, 600, 700, 800, 900, or 1,000 nm, inclusive). In some embodiments, the third support structure second layer 636 includes glass having a phosphorous content in a range of 6 wt % to 8 wt % (e.g., 6, 7, or 8 wt %, inclusive) and having a thickness in a range of 2,000 nm to 4,000 nm (e.g., 1,000, 2,200, 2,400, 2,600, 2,800, 3,000, 3,200, 3,400, 3,600, 3,800, or 4,000 nm, inclusive). In some embodiments, the third support structure third layer 637 also includes glass having a phosphorous content in a range of 3 wt % to 6 wt % (e.g., 3, 3.5, 4, 4.5, 5, 5.5, or 6 wt %, inclusive) and having a thickness in a range of 1,000 nm to 2,000 nm (e.g., 1,000, 1,100, 1,200, 1,300, 1,400, 1,500, 1,600, 1,700, 1,800, 1,900 or, or 2,000 nm, inclusive).

Figure 10:
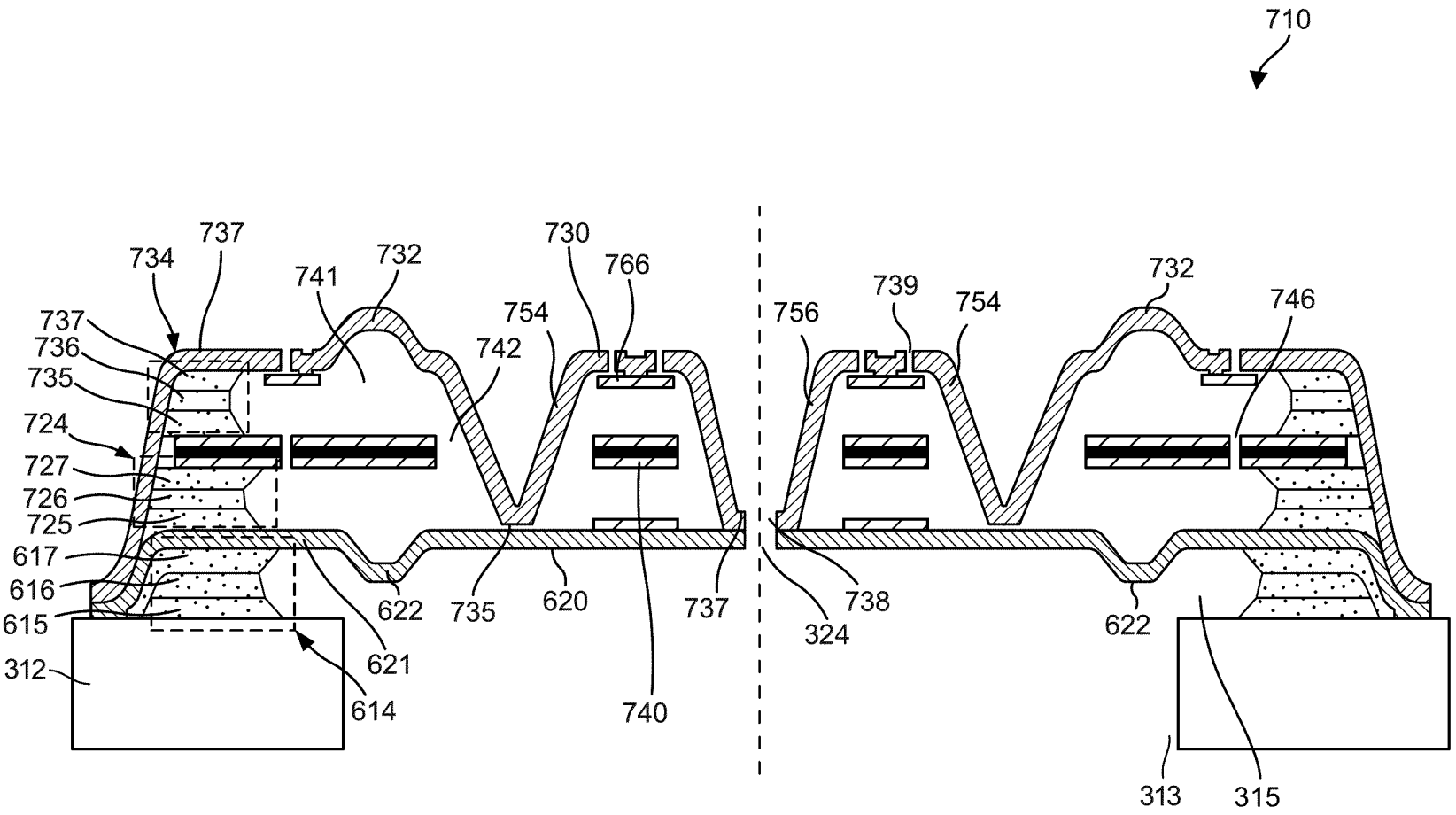
FIG. 10 is a side cross-section view of an acoustic transducer, according to yet another embodiment.

FIG. 10 is a side cross-section view of an acoustic transducer 710, according to still another embodiment. The acoustic transducer 710 may include, for example, a MEMS acoustic transducer for use in a MEMS microphone assembly or a MEMS pressure sensor. The acoustic transducer 710 is configured to generate electrical signals in response to acoustic signals or atmospheric pressure changes.

The acoustic transducer 710 includes the substrate 312 (e.g., a silicon, glass or ceramic substrate) defining the first opening 313 therein. The support structure 614 as previously described herein with respect to FIG. 9, is disposed over the substrate 312 and defines a second opening 315 therethrough which may be axially aligned with the first opening 313 so as to define at least a portion of an acoustic path of the acoustic transducer 710.

The acoustic transducer 710 includes the bottom or first diaphragm 620, as previously described herein with respect to FIG. 9, and a top or second diaphragm 730 spaced apart from the first diaphragm 620 such that a cavity 741 having a pressure lower than atmospheric pressure, for example, in a range of 1 mTorr to 10 Torr, or 1 mTorr to 1 Torr, is formed therebetween.

The back plate 740 is located between the first diaphragm 620 and the second diaphragm 730 in the cavity 741. At least portion of the first diaphragm 620, for example, proximate to a first perimetral edge 621 of the first diaphragm 620 and radially inwards thereof, is disposed on the support structure 614. The first perimetral edge 621 of the first diaphragm 620 extends beyond a perimeter of the support structure 614 and is coupled to the substrate 312. Furthermore, a second perimetral edge 737 of the second diaphragm 730 extends towards the first perimetral edge 621 and is coupled thereto.

Surfaces of each of the first diaphragm 620 and the second diaphragm 730 located outside the cavity 741 are exposed to atmosphere, for example, atmospheric air. A plurality of apertures 742 are defined in the back plate 740 such that a portion of the cavity 741 located between the first diaphragm 620 and the back plate 740 is connected to a second portion of the cavity 741 between the second diaphragm 730 and the back plate 740. Each of the first diaphragm 620 and the second diaphragm 730 includes outwardly protruding corrugations 622 and 732, respectively, as previously described herein. In various embodiments, the corrugations 622 and 732 may have a height in a range of 0.5 microns to 5 microns (e.g., 0.5, 1, 2, 3, 4 or 5 microns inclusive of all ranges and values therebetween), and a spacing measured between flat areas of the diaphragms 620, 730 is in a range of 1-15 microns (e.g., 1, 3, 5, 7, 9, 12, 14 or 15 microns inclusive of all ranges and values therebetween). It should be appreciated that the corrugations 622, 732 are circumferential and may include a plurality of corrugations.

The second diaphragm 730 includes a plurality of posts 754 extending therefrom towards the first diaphragm 620 through corresponding apertures 742 of the back plate 740. In other embodiments, the posts 754 may extend from the first diaphragm 620 towards the second diaphragm 730. The anchored post 756 extends from the first diaphragm 620 towards the second diaphragm 730 through a corresponding aperture 742 of the back plate 740. A pierce 324 is defined in the first diaphragm 720, and a throughhole 738 is defined through an apex 737 of the anchored post 756. The throughhole 738 at least partially overlaps the pierce 324 (e.g., is axially aligned with the pierce 324) and may have the same or different cross-section (e.g., diameter) as the pierce 324.

A plurality of openings 739 may also be formed in the second diaphragm 730 to allow an isotropic etchant (e.g., a wet etchant such as buffered hydrofluoric acid) to flow therethrough to etch and remove portions of a sacrificial layer that may be disposed in the cavity 741, as previously described herein. The plurality of openings 739 may be sealed, for example, with a low stress silicon nitride (LSN). A catch structure 766 is disposed beneath the opening 739 within the cavity 741 and coupled to the second diaphragm 730, as previously described herein. In some embodiments, the plurality of openings 739 defined in the second diaphragm 730 may be sealed without using the catch structure 766. In some embodiments, the catch structures 766 can be formed from a conducting material (e.g. polysilicon). The layer used to form the catch structures 766 can serve dual purpose as an electrode for the second diaphragm 730.

Different from the second diaphragm 330 and the back plate 340, the second diaphragm 730 and the back plate 740 do not include edge anchors. Instead, a perimetral edge 737 of the second diaphragm 730 extends towards the perimetral edge 721 of the first diaphragm 620 and is coupled thereto. A first peripheral support structure 324 is disposed in the cavity 741 proximate to the perimetral edge 737 of the second diaphragm 730 between the first diaphragm 620 and the back plate 740, and a second peripheral support structure 734 is disposed in the cavity 741 proximate to the perimetral edge 737 of the second diaphragm 730 between the second diaphragm 730 and the back plate 740.

The first peripheral support structure 324 includes a first peripheral support structure first layer 725, a first peripheral support structure second layer 726, and a first peripheral support structure third layer 727. In some embodiments, the first peripheral support structure first layer 725 includes silicon oxide (e.g., LPCVD silicon oxide) having a thickness in a range of 400 nm to 700 nm (e.g., 400, 450, 500, 550, 600, 650 or 700 nm, inclusive). In some embodiments, the first peripheral support structure second layer 726 includes glass having a phosphorous content in a range of 6 wt % to 8 wt % (e.g., 6, 7, or 8 wt %, inclusive) and having a thickness in a range of 1,000 nm to 2,000 nm (e.g., 1,000, 1,100, 1,200, 1,300, 1,400, 1,500, 1,600, 1,700, 1,800, 1,900, or 2,000 nm, inclusive). In some embodiments, the first peripheral support structure third layer 727 also includes glass having a phosphorous content in a range of 3 wt % to 6 wt % (e.g., 3, 3.5, 4, 4.5, 5, 5.5, or 6 wt %, inclusive) and having a thickness in a range of 1,000 nm to 2,000 nm (e.g., 1,000, 1,100, 1,200, 1,300, 1,400, 1,500, 1,600, 1,700, 1,800, 1,900, or 2,000 nm, inclusive).

The second peripheral support structure 734 includes a second peripheral support structure first layer 735, a second peripheral support structure second layer 736, and a second peripheral support structure third layer 737. In some embodiments, the second peripheral support structure first layer 735 includes glass having a phosphorous content in a range of 3 wt % to 6 wt % (e.g., 3, 3.5, 4, 4.5, 5, 5.5, or 6 wt %, inclusive) and having a thickness in a range of 500 nm to 1,000 nm (e.g., 500, 600, 700, 800, 900, or 1,000 nm, inclusive). In some embodiments, the second peripheral support structure second layer 736 includes glass having a phosphorous content in a range of 6 wt % to 8 wt % (e.g., 6, 7, or 8 wt %, inclusive) and having a thickness in a range of 2,000 nm to 4,000 nm (e.g., 1,000, 2,200, 2,400, 2,600, 2,800, 3,000, 3,200, 3,400, 3,600, 3,800, or 4,000 nm, inclusive). In some embodiments, the second peripheral support structure third layer 737 also includes glass having a phosphorous content in a range of 3 wt % to 6 wt % (e.g., 3, 3.5, 4, 4.5, 5, 5.5, or 6 wt %, inclusive) and having a thickness in a range of 1,000 nm to 2,000 nm (e.g., 1,000, 1,100, 1,200, 1,300, 1,400, 1,500, 1,600, 1,700, 1,800, 1,900 or, or 2,000 nm, inclusive).

In some embodiments, an acoustic transducer for generating electrical signals in response to acoustic signals, comprises a first diaphragm having a first corrugation formed therein, and a second diaphragm having a second corrugation formed therein. The second diaphragm is spaced apart from the first diaphragm such that a cavity is formed therebetween, the cavity having a pressure lower than atmospheric pressure. A back plate disposed in the cavity between the first diaphragm and the second diaphragm.

In some embodiments, each of the first corrugation and the second corrugation protrude outwardly from the first diaphragm and the second diaphragm, respectively, in a direction away from the back plate.

In some embodiments, the back plate defines at least one aperture therethrough such that a portion of the cavity located between the first diaphragm and the back plate is connected to a portion of the cavity located between the second diaphragm and the back plate.

In some embodiments, the acoustic transducer further comprises a substrate defining a first opening therein, and a support structure disposed on the substrate and defining a second opening corresponding to the first opening of the substrate. At least a portion of the first diaphragm is disposed on the support structure. In some embodiments, the support structure comprises a phosphosilicate glass layer.

In some embodiments, the acoustic transducer further comprises a peripheral support structure attached to and supporting at least a portion of a periphery of the first diaphragm and the second diaphragm, the peripheral support structure located proximate to an edge of the first and second diaphragms. In some embodiments, the peripheral support structure comprises at least a first layer and a second layer, each of the first and second layers comprising phosphosilicate glass (PSG). In some embodiments, the first layer has a first phosphorus content and the second layer has a second phosphorus content different from the first phosphorus content. In some embodiments, a radially inner sidewall of the peripheral support structure has a tapered profile In some embodiments, at least one of the first diaphragm or the second diaphragm comprises a first diaphragm layer and a second diaphragm layer disposed on the first diaphragm layer.

In some embodiments, at least one of the first diaphragm or the second diaphragm comprises a stress relieving structure adjacent to a periphery of the respective first or second diaphragm. The stress relieving structure has a thickness that is greater than a thickness of a portion of the respective first or second diaphragm proximate a center of the respective first or second diaphragm. In some embodiments, the stress relieving structure comprises phosphosilicate glass embedded between two layers of silicon nitride. In some embodiments, the stress relieving structure comprises silicon nitride.

In some embodiments, an acoustic transducer for generating electrical signals in response to acoustic signals, comprises a first diaphragm, and a second diaphragm spaced apart from the first diaphragm such that a cavity is formed therebetween, the cavity having a pressure lower than atmospheric pressure. A back plate disposed in the cavity between the first diaphragm and the second diaphragm. A post extends from the second diaphragm towards the first diaphragm through an aperture defined in the back plate. A portion of the post configured to contact the first diaphragm in response to movement of the second diaphragm towards the first diaphragm.

In some embodiments, the acoustic transducer further comprises a substrate defining a first opening therein, and a support structure disposed on the substrate and defining a second opening corresponding to the first opening of the substrate. At least a portion of the first diaphragm is disposed on the support structure.

In some embodiments, an acoustic transducer for generating electrical signals in response to acoustic signals comprises a first diaphragm having a first corrugation formed therein, and second diaphragm having a second corrugation formed therein, the second diaphragm spaced apart from the first diaphragm such that a cavity is formed therebetween, the cavity having a pressure lower than atmospheric pressure. A back plate is disposed in the cavity between the first diaphragm and the second diaphragm. A post extends from the second diaphragm towards the first diaphragm through an aperture defined in the back plate. A portion of the post is configured to contact the first diaphragm in response to movement of the second diaphragm towards the first diaphragm.

In some embodiments, each of the first corrugation and the second corrugation protrude outwardly from the first diaphragm and the second diaphragm, respectively, in a direction away from the back plate.

In some embodiments, the acoustic transducer further comprises an anchored post extending from the second diaphragm towards the first diaphragm through a corresponding aperture in the back plate. An apex of the anchored post contacts the first diaphragm and is coupled thereto. A throughhole is defined through the apex and a pierce defined through the first diaphragm, the pierce at least partially overlapping with the throughhole.

In some embodiments, the acoustic transducer further comprises a substrate defining a first opening therein. A support structure is disposed on the substrate and defining a second opening corresponding to the first opening of the substrate. At least a portion of the first diaphragm is disposed on the support structure.

In some embodiments, the acoustic transducer further comprises a peripheral support structure attached to and supporting at least a portion of a periphery of the first diaphragm and the second diaphragm, the peripheral support structure located proximate to an edge of the first and second diaphragms.

In some embodiments, at least one of the first diaphragm or the second diaphragm further comprises a stress relieving structure adjacent to a periphery of the respective first or second diaphragm, the stress relieving structure having a thickness that is greater than a thickness of a portion of the respective first or second diaphragm proximate a center of the respective first or second diaphragm.

In some embodiments, a microphone assembly comprises: a base. A lid is positioned on the base, a port defined in one of the base or the lid. An acoustic transducer is positioned on the base and separates a front volume from a back volume of the microphone assembly, the front volume being in fluidic communication with the port. The acoustic transducer comprises a first diaphragm having a first corrugation formed therein, and second diaphragm having a second corrugation formed therein, the second diaphragm spaced apart from the first diaphragm such that a cavity is formed therebetween, the cavity having a pressure lower than atmospheric pressure. A back plate is disposed in the cavity between the first diaphragm and the second diaphragm. A post extends from the second diaphragm towards the first diaphragm through an aperture defined in the back plate. A portion of the post is configured to contact the first diaphragm in response to movement of the second diaphragm towards the first diaphragm. An integrated circuit is electrically coupled to the acoustic transducer. The integrated circuit is configured to measure an out-of-phase change in capacitance between the first diaphragm and the back plate, and the second diaphragm and the back plate in response to receiving an acoustic signal through the port, the out-of-phase change in capacitance corresponding to the acoustic signal.

In some embodiments, a pressure sensing assembly comprises a base. A lid is positioned on the base, a port defined in one of the base or the lid. An acoustic transducer is positioned on the base and separates a front volume from a back volume of the pressure sensing assembly, the front volume being in fluidic communication with the port. The acoustic transducer comprises a first diaphragm having a first corrugation formed therein, and second diaphragm having a second corrugation formed therein, the second diaphragm spaced apart from the first diaphragm such that a cavity is formed therebetween, the cavity having a pressure lower than atmospheric pressure. A back plate is disposed in the cavity between the first diaphragm and the second diaphragm. A post extends from the second diaphragm towards the first diaphragm through an aperture defined in the back plate. A portion of the post is configured to contact the first diaphragm in response to movement of the second diaphragm towards the first diaphragm. An integrated circuit id electrically coupled to the acoustic transducer, the integrated circuit configured to measure an in-phase change in capacitance between the first diaphragm and the back plate, and the second diaphragm and the back plate in response to changes in atmospheric pressure relative to a pressure in the cavity.

In some embodiments, a method comprises providing a substrate; forming a first diaphragm attached at its periphery to the substrate, the first diaphragm having a corrugation extending towards the substrate; forming a back plate spaced from the first diaphragm in a direction away from the substrate and attached at its periphery to the substrate; forming a second diaphragm spaced from the back plate in a direction away from the substrate and attached at its periphery to the substrate, the second diaphragm having a corrugation extending away from the substrate; and forming a cavity between the first and second diaphragms using isotropic etching to remove structural material from between the first diaphragm and the second diaphragm; depositing a sealing layer to seal the cavity such that the cavity has a pressure lower than atmospheric pressure; and forming an opening in the substrate beneath the first diaphragm. In some embodiments, the pressure in the cavity is in a range of 1 mTorr to 1 Torr.

In some embodiments, the back plate defines at least one aperture therethrough such that a portion of the cavity located between the first diaphragm and the back plate is connected to a portion of the cavity located between the second diaphragm and the back plate In some embodiments, forming the second diaphragm further comprises forming a post in the second diaphragm extending towards the first diaphragm through an aperture defined in the back plate, a portion of the post configured to contact the first diaphragm in response to movement of the second diaphragm towards the first diaphragm.

In some embodiments, forming the second diaphragm further comprises forming an anchored post in the second diaphragm extending towards the first diaphragm through a corresponding aperture in the back plate, an apex of the anchored post contacting the first diaphragm and coupled thereto, a throughhole defined through the apex and a pierce defined through the first diaphragm, the pierce at least partially overlapping with the throughhole.

In some embodiments, an acoustic transducer for generating electrical signals in response to acoustic signals, comprises: a first diaphragm including a stress relieving structure adjacent a periphery of the first diaphragm, the stress relieving structure having a thickness that is greater than a thickness of a portion of the first diaphragm proximate a center of the first diaphragm. A second diaphragm is spaced apart from the first diaphragm so as to define a cavity therebetween, the cavity being at a pressure lower than atmospheric pressure. A back plate is located between the first diaphragm and the second diaphragm in the cavity.

In some embodiments, the stress relieving structure comprises phosphosilicate glass embedded between two layers of silicon nitride. In some embodiments, the stress relieving structure comprises silicon nitride.

In some embodiments, the acoustic transducer further comprises a peripheral support structure attached to and supporting at least a portion of a periphery of the first diaphragm and the second diaphragm, the peripheral support structure located proximate to an edge of the first and second diaphragms. In some embodiments, the peripheral support structure comprises at least a first layer and a second layer, each of the first and second layers comprising phosphosilicate glass (PSG). In some embodiments, the first layer has a first phosphorus content and the second layer has a second phosphorus content different from the first phosphorus content.

In some embodiments, a radially inner sidewall of the peripheral support structure has a tapered profile.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An acoustic transducer for generating electrical signals in response to acoustic signals, comprising:

a first diaphragm having a first corrugation formed therein;

a second diaphragm having a second corrugation formed therein, the second diaphragm spaced apart from the first diaphragm such that a cavity is formed therebetween, the cavity having a pressure lower than atmospheric pressure;

a back plate disposed in the cavity between the first diaphragm and the second diaphragm; and one or more posts extending from at least one of the first diaphragm or the second diaphragm towards the other of the first diaphragm or the second diaphragm through a corresponding aperture defined in the back plate, a tip of at least a portion of the one or more posts being spaced apart from the other of the first diaphragm or the second diaphragm, the tip configured to contact the first diaphragm in response to movement of at least one of the first diaphragm or the second diaphragm towards the other of the first diaphragm or the second diaphragm to prevent each of the first diaphragm and the second diaphragm from contacting the back plate due to movement of the first diaphragm and/or the second diaphragm towards the back plate, wherein each of the first corrugation and the second corrugation protrude outwardly from the first diaphragm and the second diaphragm, respectively, in a direction away from the back plate.

2. The acoustic transducer of claim 1, wherein each of the first diaphragm and the second diaphragm include a plurality of outwardly protruding corrugations.

3. The acoustic transducer of claim 1, wherein a portion of the one or more posts extend from the second diaphragm towards the first diaphragm such that a tip of the one or more posts are disposed on and coupled to the first diaphragm.

4. The acoustic transducer of claim 1, further comprising an anchored post extending from the second diaphragm towards the first diaphragm through a corresponding aperture in the back plate, an apex of the anchored post contacting the first diaphragm and coupled thereto, a throughhole defined through the apex and a pierce defined through the first diaphragm, the pierce at least partially overlapping with the throughhole.

5. The acoustic transducer of claim 1, further comprising:

a substrate defining a first opening therein; and a support structure disposed on the substrate and defining a second opening corresponding to the first opening of the substrate, wherein at least a portion of the first diaphragm is disposed on the support structure.

6. The acoustic transducer of claim 5, wherein the support structure comprises a glass layer having no phosphorus, or a phosphorous content in a range of 0.01 wt % to 10 wt %.

7. The acoustic transducer of claim 1, further comprising a peripheral support structure attached to and supporting at least a portion of a periphery of the first diaphragm and/or the second diaphragm, the peripheral support structure located proximate to, and radially inwards of a peripheral edge of the first and second diaphragms within the cavity, at least a portion of at least one of the first diaphragm or the second diaphragm being radially outwards of the a peripheral edge of the support structure.

8. The acoustic transducer of claim 7, wherein the peripheral support structure comprises at least a first layer and a second layer, each of the first layer and the second layer comprising glass having no phosphorous, or a phosphorous content in a range of 0.01 wt % to 10 wt %.

9. The acoustic transducer of claim 8, wherein the first layer has a first phosphorus content and the second layer has a second phosphorus content different from the first phosphorus content.

10. The acoustic transducer of claim 9, wherein a radially inner sidewall of the peripheral support structure has a tapered profile.

11. The acoustic transducer of claim 1, wherein at least one of the first diaphragm or the second diaphragm comprises a first diaphragm layer and a second diaphragm layer disposed on the first diaphragm layer.

12. The acoustic transducer of claim 1, wherein at least one of the first diaphragm or the second diaphragm further comprises a stress relieving structure adjacent to a periphery of the respective first or second diaphragm, the stress relieving structure having a thickness that is greater than a thickness of a portion of the respective first or second diaphragm proximate a center of the respective first or second diaphragm.

13. The acoustic transducer of claim 12, wherein the stress relieving structure comprises glass embedded between two layers of silicon nitride, the glass having no phosphorus, or a phosphorus content in a range of 0.01 wt % to 10 wt %.

14. The acoustic transducer of claim 12, wherein the stress relieving structure comprises silicon nitride.

15. The acoustic transducer of claim 1, wherein a pressure in the cavity is in a range of 1 mTorr to 1 Torr.

16. The acoustic transducer of claim 1, further comprising overpressure stops formed in at least one of the first diaphragm, the second diaphragm, or the back plate.

17. A microphone assembly, comprising:

a base;

a lid positioned on the base, a port defined in one of the base or the lid;

an acoustic transducer positioned on the base or the lid and separating a front volume from a back volume of the microphone assembly, the front volume being in fluidic communication with the port, the acoustic transducer comprising:

a first diaphragm having a first corrugation formed therein, a second diaphragm having a second corrugation formed therein, the second diaphragm spaced apart from the first diaphragm such that a cavity is formed therebetween, the cavity having a pressure lower than atmospheric pressure, a back plate disposed in the cavity between the first diaphragm and the second diaphragm, and one or more posts extending from at least one of the first diaphragm or the second diaphragm towards the other of the first diaphragm or the second diaphragm through a corresponding aperture defined in the back plate, a tip of at least a portion of the one or more posts being spaced apart from the other of the first diaphragm or the second diaphragm, the tip configured to contact the first diaphragm in response to movement of at least one of the first diaphragm or the second diaphragm towards the other of the first diaphragm or the second diaphragm to prevent each of the first diaphragm and the second diaphragm from contacting the back plate due to movement of the first diaphragm and/or the second diaphragm towards the back plate, wherein each of the first corrugation and the second corrugation protrude outwardly from the first diaphragm and the second diaphragm, respectively, in a direction away from the back plate; and an integrated circuit electrically coupled to the acoustic transducer, the integrated circuit configured to measure a change in capacitance between the first diaphragm and the back plate, and the second diaphragm and the back plate in response to receiving an acoustic signal through the port, the change in capacitance corresponding to the acoustic signal.

18. An acoustic transducer for generating electrical signals in response to acoustic signals, comprising:

a first diaphragm having a first corrugation formed therein;

a second diaphragm having a second corrugation formed therein, the second diaphragm spaced apart from the first diaphragm such that a cavity is formed therebetween, the cavity having a pressure lower than atmospheric pressure;

a back plate disposed in the cavity between the first diaphragm and the second diaphragm;

one or more posts extending from at least one of the first diaphragm or the second diaphragm towards the other of the first diaphragm or the second diaphragm through a corresponding aperture defined in the back plate, the one or more posts configured to prevent each of the first diaphragm and the second diaphragm from contacting the back plate due to movement of the first diaphragm and/or the second diaphragm towards the back plate;

a peripheral support structure attached to and supporting at least a portion of a periphery of the first diaphragm and the second diaphragm, the peripheral support structure located proximate to, and inwards of a peripheral edge of the first and second diaphragms within the cavity, at least a portion of at least one of the first diaphragm or the second diaphragm being radially outwards of the peripheral edge of the support structure;

a substrate defining a first opening therein; and a support structure disposed on the substrate and defining a second opening corresponding to the first opening of the substrate, at least a portion of the first diaphragm is disposed on the support structure, wherein each of the first corrugation and the second corrugation protrude outwardly from the first diaphragm and the second diaphragm, respectively, in a direction away from the back plate.

19. The acoustic transducer of claim 18, wherein each of the first diaphragm and the second diaphragm include a plurality of outwardly protruding corrugations.

20. The acoustic transducer of claim 18, wherein the peripheral support structure comprises a plurality of layers, each of the plurality of layers comprising glass having no phosphorus, or a phosphorus content in a range of 0.01 wt % to 10 wt %.

21. An acoustic transducer for generating electrical signals in response to acoustic signals, comprising:

a first diaphragm having a first corrugation formed therein;

a second diaphragm having a second corrugation formed therein, the second diaphragm spaced apart from the first diaphragm such that a cavity is formed therebetween, the cavity having a pressure lower than atmospheric pressure;

a back plate disposed in the cavity between the first diaphragm and the second diaphragm;

one or more posts extending from at least one of the first diaphragm or the second diaphragm towards the other of the first diaphragm or the second diaphragm through a corresponding aperture defined in the back plate, the one or more posts configured to prevent each of the first diaphragm and the second diaphragm from contacting the back plate due to movement of the first diaphragm and/or the second diaphragm towards the back plate; and an anchored post extending from the second diaphragm towards the first diaphragm through a corresponding aperture in the back plate, an apex of the anchored post contacting the first diaphragm and coupled thereto, a throughhole defined through the apex and a pierce defined through the first diaphragm, the pierce at least partially overlapping with the throughhole, wherein each of the first corrugation and the second corrugation protrude outwardly from the first diaphragm and the second diaphragm, respectively, in a direction away from the back plate.

22. An acoustic transducer for generating electrical signals in response to acoustic signals, comprising:

a first diaphragm having a first corrugation formed therein;

a second diaphragm having a second corrugation formed therein, the second diaphragm spaced apart from the first diaphragm such that a cavity is formed therebetween, the cavity having a pressure lower than atmospheric pressure;

a stress relieving structure adjacent to a periphery of at least one of the first diaphragm or the second diaphragm, the stress relieving structure comprising a first material embedded between a first diaphragm layer and a second diaphragm layer of at least one of the first diaphragm or the second diaphragm such that the stress relieving structure has a thickness that is greater than a thickness of a portion of the respective first diaphragm or the second diaphragm proximate a center of the respective first diaphragm or the second diaphragm;

a back plate disposed in the cavity between the first diaphragm and the second diaphragm; and one or more posts extending from at least one of the first diaphragm or the second diaphragm towards the other of the first diaphragm or the second diaphragm through a corresponding aperture defined in the back plate, the one or more posts configured to prevent each of the first diaphragm and the second diaphragm from contacting the back plate due to movement of the first diaphragm and/or the second diaphragm towards the back plate, wherein each of the first corrugation and the second corrugation protrude outwardly from the first diaphragm and the second diaphragm, respectively, in a direction away from the back plate.

23. The acoustic transducer of claim 22, wherein the first material comprises glass and the first and second diaphragm layers comprise silicon nitride, the glass having no phosphorus, or a phosphorus content in a range of 0.01 wt % to 10 wt %.

24. The acoustic transducer of claim 22, wherein the first material comprises silicon nitride.

* * * * *